US010273676B2

(12) United States Patent
Wyllie et al.

(10) Patent No.: US 10,273,676 B2
(45) Date of Patent: Apr. 30, 2019

(54) ARCHITECTURAL STRUCTURES HAVING AN EXPANDABLE FRAME

(71) Applicant: Marywood University, Scranton, PA (US)

(72) Inventors: William Kevin Wyllie, Fairfax, VA (US); Thomas Alexander Gongliewski, Throop, PA (US)

(73) Assignee: Marywood University, Scranton, PA (US)

( * ) Notice: Subject to any disclaimer, the term of this patent is extended or adjusted under 35 U.S.C. 154(b) by 0 days.

(21) Appl. No.: 15/515,415

(22) PCT Filed: Oct. 14, 2015

(86) PCT No.: PCT/US2015/055520

§ 371 (c)(1),
(2) Date: Mar. 29, 2017

(87) PCT Pub. No.: WO2016/061217

PCT Pub. Date: Apr. 21, 2016

(65) Prior Publication Data

US 2017/0211273 A1 Jul. 27, 2017

Related U.S. Application Data

(60) Provisional application No. 62/064,079, filed on Oct. 15, 2014.

(51) Int. Cl.
*A47B 1/08* (2006.01)
*E04B 1/19* (2006.01)
(Continued)

(52) U.S. Cl.
CPC ..... *E04B 1/1903* (2013.01); *A47B 1/08* (2013.01); *A47B 45/00* (2013.01); *E04B 2/721* (2013.01); *E04B 2/7416* (2013.01); *E04C 2/427* (2013.01); *E04C 3/005* (2013.01); *E04C 3/02* (2013.01); *E04C 3/30* (2013.01); *E04C 3/38* (2013.01);
(Continued)

(58) Field of Classification Search
CPC ... E04C 3/30; A47B 45/00; A47B 1/08; E04B 1/1903; E04B 2/7416; E04B 2001/1957
See application file for complete search history.

(56) References Cited

U.S. PATENT DOCUMENTS 429,095 A 5/1890 Livingstone
684,130 A 10/1901 Taubert
(Continued)

OTHER PUBLICATIONS

International Search Report dated Dec. 7, 2015 in International Application No. PCT/US2015/055520.
(Continued)

*Primary Examiner* — Phi D A
*Assistant Examiner* — Omar F Hijaz
(74) *Attorney, Agent, or Firm* — Kim Winston LLP

(57) ABSTRACT

An architectural structure for constructing a variety of goods in a variety of configurations is provided. The architectural structure includes a plurality of paired slat-like members and a spine configured to hold the plurality of paired slat-like members in an expanded state. Each paired slat-like members includes joined upper ends, joined lower ends and an expandable central region joined to an adjacent paired slat-like members.

13 Claims, 32 Drawing Sheets

(51) Int. Cl.

| | |
|---|---|
| ***E04B 2/72*** | (2006.01) |
| ***E04B 2/74*** | (2006.01) |
| ***E04B 9/34*** | (2006.01) |
| ***E04C 2/42*** | (2006.01) |
| ***E04C 3/00*** | (2006.01) |
| ***E04C 3/02*** | (2006.01) |
| ***E04C 3/30*** | (2006.01) |
| ***E04C 3/38*** | (2006.01) |
| ***E04C 3/42*** | (2006.01) |
| ***A47B 45/00*** | (2006.01) |

(52) U.S. Cl.

CPC ..... *E04C 3/42* (2013.01); *E04B 9/345* (2013.01); *E04B 2001/1924* (2013.01); *E04B 2001/1957* (2013.01); *E04B 2002/7483* (2013.01); *E04C 2003/026* (2013.01)

(56) References Cited

U.S. PATENT DOCUMENTS

| | | | | | |
|---|---|---|---|---|---|
| 834,873 | A | | 10/1906 | Curtis | |
| 919,257 | A | | 4/1909 | Seydewitz | |
| 1,168,891 | A | | 1/1916 | Kranebiel | |
| 2,324,398 | A | | 7/1943 | Kahr | |
| 2,486,170 | A | | 10/1949 | Kavanaugh | |
| 2,675,769 | A | * | 4/1954 | Dosker | E04B 7/00 52/641 |
| 2,692,019 | A | * | 10/1954 | Zalkind | B21D 31/04 126/291 |
| 2,722,979 | A | * | 11/1955 | Janowitz | A47F 5/105 160/130 |
| 2,799,332 | A | | 7/1957 | Scheff | |
| 2,865,387 | A | | 12/1958 | Annibaldi | |
| 3,148,725 | A | | 9/1964 | McPhaden | |
| 3,177,925 | A | | 4/1965 | Miller | |
| 3,496,687 | A | | 2/1970 | Greenberg et al. | |
| 3,526,066 | A | | 9/1970 | Hagar et al. | |
| 3,559,353 | A | | 2/1971 | Partridge | |
| 3,674,081 | A | | 7/1972 | List | |
| 4,006,768 | A | | 2/1977 | Horgan, Jr. | |
| 4,013,114 | A | | 3/1977 | Goebel | |
| 4,221,032 | A | * | 9/1980 | Cousino | B21D 31/04 29/2 |
| 4,262,460 | A | | 4/1981 | Bertin | |
| 4,452,025 | A | * | 6/1984 | Lew | E04C 2/422 52/665 |
| 4,649,947 | A | | 3/1987 | Tury et al. | |
| 4,667,692 | A | | 5/1987 | Tury et al. | |
| 4,844,109 | A | | 7/1989 | Navarro | |
| 7,377,231 | B2 | | 5/2008 | Tsai | |
| 7,803,466 | B2 | * | 9/2010 | Dorsy | E04C 2/08 428/131 |
| 7,803,467 | B2 | | 9/2010 | Dorsy | |
| 8,051,890 | B2 | | 11/2011 | Broyan | |
| 8,084,141 | B2 | | 12/2011 | Dorsy | |
| 8,776,876 | B2 | | 7/2014 | Hart et al. | |
| 2007/0237923 | A1 | | 10/2007 | Dorsy | |
| 2007/0256387 | A1 | * | 11/2007 | Dorsy | E04C 2/08 52/588.1 |
| 2009/0294078 | A1 | | 12/2009 | Feldpausch et al. | |
| 2010/0126076 | A1 | * | 5/2010 | Broyan | E06B 3/928 49/404 |

OTHER PUBLICATIONS

Written Opinion dated Dec. 7, 2015 in International Application No. PCT/US2015/055520.

* cited by examiner

ARCHITECTURAL STRUCTURES HAVING AN EXPANDABLE FRAME

CROSS-REFERENCE TO RELATED APPLICATIONS

This application is a national phase application under 35 U.S.C. § 371 of International Application No. PCT/US2015/055520 filed Oct. 14, 2015 entitled "Architectural Structures Having an Expandable Frame," which claims the benefit of U.S. Provisional Patent Application No. 62/064,079 filed Oct. 15, 2014 entitled "Rapid Install Partition System," the entire disclosures of which are hereby incorporated by reference herein for all purposes.

BACKGROUND OF THE INVENTION

The present invention relates generally to an architectural structure that can be rapidly deployed. In particular, the present invention relates to an architectural structure having expandable paired slat-like members capable of constructing e.g., a room partition, furniture, a cubicle, a building frame or artwork.

Standard architectural structures used e.g., to create room partitions, are made from materials that require significant assembly and skill to properly construct. For example, standard wood partition assemblies use nominal size lumber with standard spacing to create a vertical height that is secured about its top and bottom portions with similar material. Such assemblies are cumbersome, and the quality of the constructed assembly is subjected to discrepancies in material and skilled or unskilled labor involved. Further, due to the use of conventional materials and assembly methods, such assemblies allow for increased thermal bridging of cold air in exterior use applications.

With respect to conventional demountable and temporary display systems, they require multiple material components and connection assemblies which may be subjected to assembly failure when damaged.

Thus, there is still a need for an architectural structure that can be easily and rapidly assembled to a desired configuration that addresses the foregoing needs. Such a need is satisfied by the architectural structure of the present invention.

BRIEF SUMMARY OF THE INVENTION

In accordance with a preferred embodiment, the present invention provides an architectural structure that includes a plurality of paired slat-like members, and a spine configured to hold the plurality of paired slat-like members in an expanded state. Each of the plurality of paired slat-like members includes joined upper ends, joined lower ends and an expandable central region joined to an adjacent paired slat-like members.

In accordance with another preferred embodiment, the present invention provides an architectural structure that includes a plurality of sections, and a spine having a plurality of retaining fixtures to retain a portion of each section. Each of the plurality of sections includes a first elongate member and a second elongate member. The upper ends and lower ends of the first and second elongate members are joined, and each section is connected to another section about an expandable central region of the section. The plurality of retaining fixtures are preferably configured as spaced apart apertures, spaced apart slip joints or spaced apart fasteners.

In accordance with yet another preferred embodiment, the present invention provides an architectural structure that includes an expandable structure, and a spine configured to support the expandable structure in an expanded position. The expandable structure includes a first slat, a second slat, a third slat and a fourth slat. The first slat includes a first major surface and a second major surface opposite the first major surface. The second slat includes a first major surface and a second major surface opposite the first major surface. The first and second slats have upper and lower ends of respective first major surfaces connected together. The third slat includes a first major surface and a second major surface opposite the first major surface. The second major surface of the third slat is connected to the second major surface of the second slat about respective midportions. The fourth slat includes a first major surface and a second major surface opposite the first major surface. The fourth and third slats have upper and lower ends of respective first major surfaces connected together. Further, the expandable structure is moveable between a collapsed position and an expanded position.

In accordance with another preferred embodiment, the present invention provides a method of constructing an architectural wall comprising the steps of providing an architectural structure that includes a plurality of paired slat-like members, and a spine configured to hold the plurality of paired slat-like members in an expanded state. Each of the plurality of paired slat-like members includes joined upper ends, joined lower ends and an expandable central region joined to an adjacent paired slat-like members. The method further includes the steps of assembling the spine to the plurality of paired slat-like members, and inserting insulation between the slat-like members of the plurality of paired slat-like members.

In accordance with an aspect of the present invention, there is provided an architectural structure that requires minimal materials and which can be rapidly installed with unskilled labor. In accordance with an aspect, the architectural structure can be configured as a partition assembly in which the vertical structure or expandable structure is expandable by pulling and then locked into place with an intermediary hold that may also act as part of a work surface or a hanging mount for a depending skin assembly based on a particular design preference. The design of the architectural structure can be rapidly installed as a partition, an exterior wall or self-assembled furniture component, and requires unskilled labor and minimal use of materials. For example, assembly of the architectural structure uses plywood type materials that is low-cost, structurally efficient and environmentally sustainable. The foregoing architectural structure advantageously provides cost-effectiveness, environmental sustainability, unskilled and quick assembly, minimal shipping cost, factory controlled fabrication, a thoroughly more efficient product when used as an exterior partition, excellent acoustic control when used with insulation, and a visually pleasing aesthetics. Further, the architectural structure can be flat pack shipped, and when used as an open office work station, it is ergonomically efficient. For example, the serpentine design provides structural stability.

The architectural structure advantageously provides for a reduction in materials for construction and can be fabricated from materials, such as but not limited to, wood, aluminum, fiberglass, reinforced multi-fiber strains, plastics, other composite materials similar to materials used to fabricate a snow ski, a snow board, or multi-ply materials similar to the construction of flexible objects. For example, the slats of the present invention can be made from materials similar those used to make a snow board e.g., from eight main materials: 1) a topsheet, 2) fiber glass or epoxy, 3) wood or foam core, 4) steel inserts, 5) plastic base, (p-tex), 6) metal edges, 7) resin system (glue), and 8) rubber foil. Carbon fiber can be added along with other performance enhancing materials.

A snowboard is similar to a sandwich that is made up of many layers. What follows are the components of a snowboard from top to bottom: The top layer of a snowboard is a protective plastic layer called a "topsheet." The topsheet does not only protect the insides of the snowboard from damage and exposure to ultra-violet rays, it also provides a good surface for graphics. Although the material used for the topsheet can vary, there are basically two types of topsheets—the glossy and matte. Glossy topsheets usually come with sublimated graphics. On the other hand, matte topsheets in general have screened-on graphics. Inside the topsheet is a layer of "fiberglass". This fiberglass lies on top of the core. The snowboard's "core", which lies beneath the fiberglass, is what the rest of the board is wrapped around with. The core makes up most of the thickness of the snowboard. This is usually made of wood foam, honeycomb panels, or a combination of wood and other composite materials, with sets of metal inserts needed to mount bindings. Cores made from honeycomb are lightweight and are surprisingly strong. With a wood core, a smooth response and lively flex from the board is provided. Next is another layer of fiberglass, "fiberglass reinforced plastic" in particular. This provides stiffness and strength to the snowboard. Following the fiberglass are steel edges. These edges surround the P-tex of the snowboard, allowing the board to dig into the snow while turning. There are actually two kinds of edges: partial steel edges that run only along the sides of the board, ending at the nose and tail, and edges that wrap all the way around both ends of the board. On the bottom is a layer of ultra high molecular weight polyethylene material commonly called "P-Tex." This is a dense, abrasion resistant plastic with low friction properties which provides the slippery surface that makes the snowboard slide on snow surface.

The slats of the present invention can also be made from materials similar to skis e.g., from cores made laminated strips of hardwoods like beech, birch, aspen, paulownia, fuma, ash, fir, maple, spruce, poplar, or bamboo, generally with strips of different woods being laminated together. Wood is used as it gives a lively feel with good vibration damping, it keeps its shape well, and has a fairly low resonance. Many other materials can be added to or used instead of wood for the core though, including: Carbon—light, lively, strong and very good under compression; Kevlar—strong, reasonably light, good under tension, and a good dampener; Aluminium Honeycomb—very light and strong; Fibreglass—relatively strong, light and inexpensive; Titanium—very light and strong, with good damping properties; Air—when used correctly, air can decrease the weight of a ski core without having any major effect on the core's strength; and Foam—if large amounts of foam are used in a core it is often done by using a composite torsion box to create most of the ski's strength and flex characteristics.

The architectural structure of the present invention provides a means to create a new type of open office work station that takes advantage of human ergonomics and the arm's reach to replace the orthogonal design of the typical workspace cube farm. Preferably, the architectural structure is configured to include curved wall sections in a cost efficient manner which uses significantly less material volume and can be shipped in an unexpanded state and then expanded and assembled on-site to create a semi-private workspace. The materials for the configuration of such workstations are made from any type of sheet material currently known or to be developed suitable for the intended use of the various embodiments of the present invention. For example, the workstations and other architectural structures can be made from a ¼ inch lauan sheet connected in a particular pattern to create a series of springs which are then intersected with a plane of ¾ inch lauan or any other material suitable for use e.g., as a work surface and/or structural spine.

In accordance with an aspect, the architectural structure becomes significantly more structural when combined with rigid or rigid spray foam insulation allowing the plywood frame to be stabilized by the rigidity of the insulation. Because of the thin profile of the framing system, thermal heat transference is reduced and the increased area of the foam allows for better insulation R values. Electrical and plumbing can be incorporated prior to the installation of the foam via conduit runs through the architectural structure.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Figure 1:
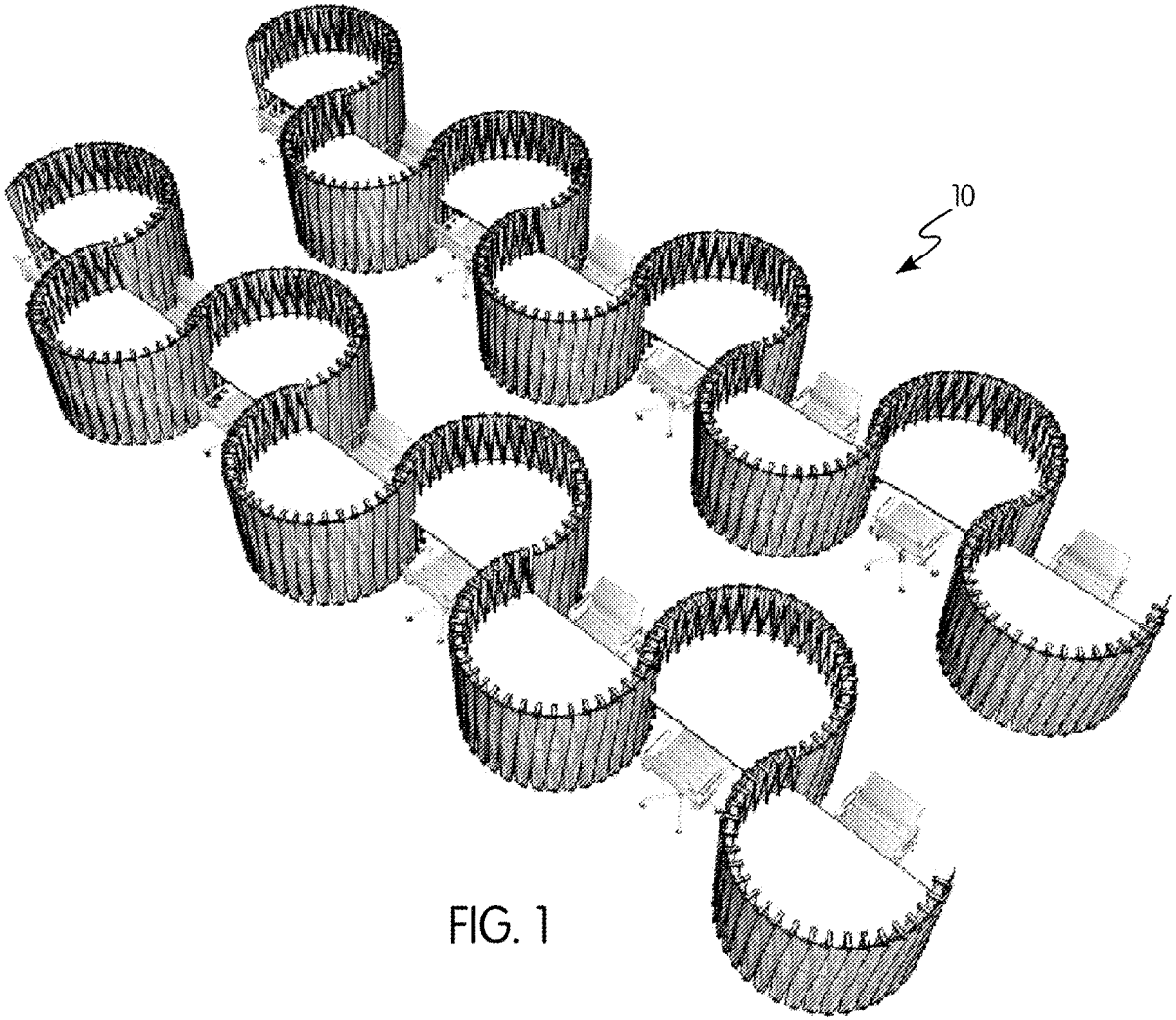
FIG. 1 is a perspective view of an architectural structure configured as a plurality of work stations or cubicles in accordance with a preferred embodiment of the present invention.

Referring now to the drawings wherein preferred embodiments of the present invention are shown, FIG. 1 illustrates an architectural structure 10 of the present invention as applied to a cubicle assembly. The architectural structure 10 can used in a variety of ways, such as but not limited to, a room partition, furniture, a building frame or artwork.

Figure 2A:
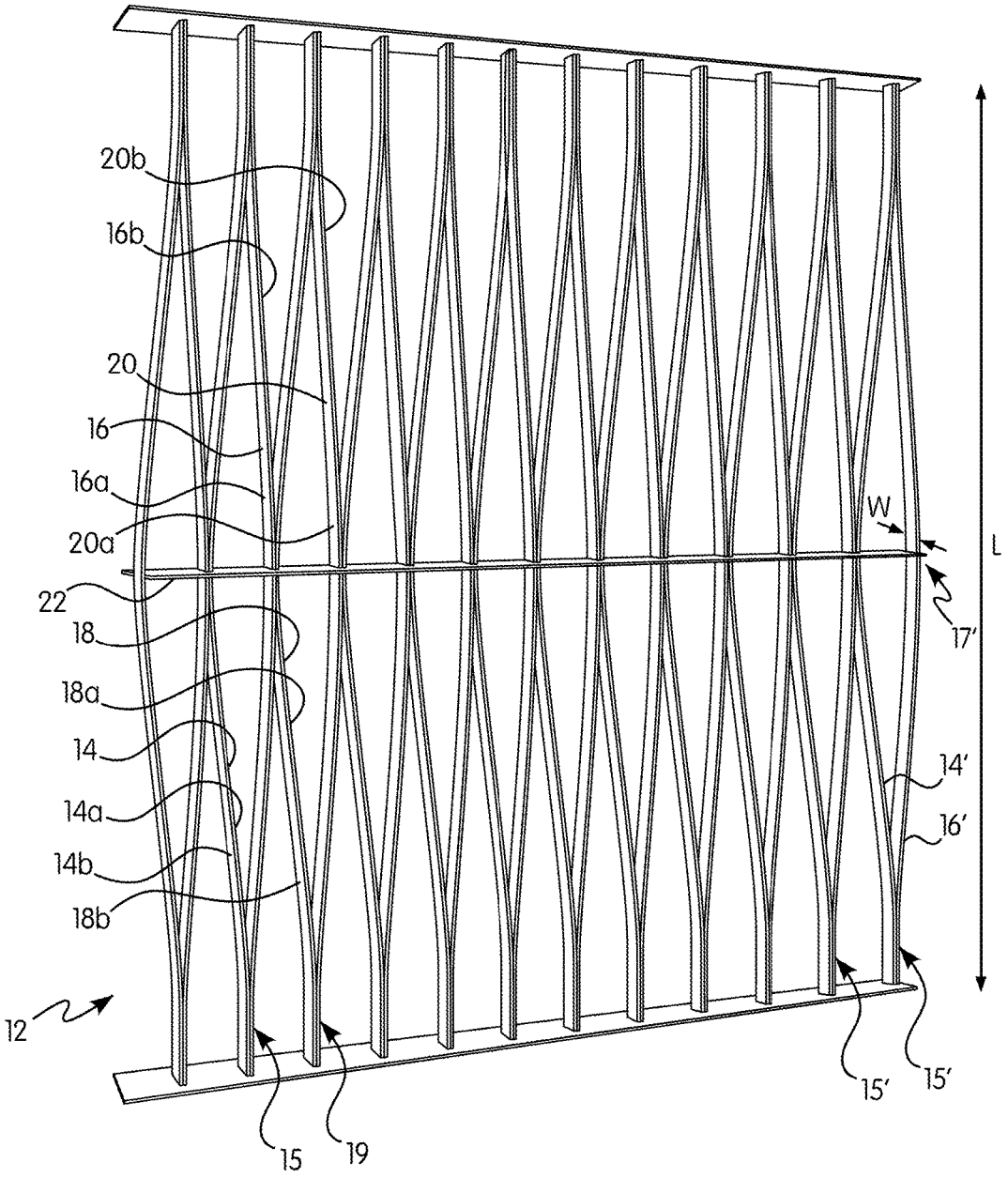
FIG. 2A is a perspective view of an architectural structure configured as a wall partition in accordance with another preferred embodiment of the present invention.
Figure 2B:
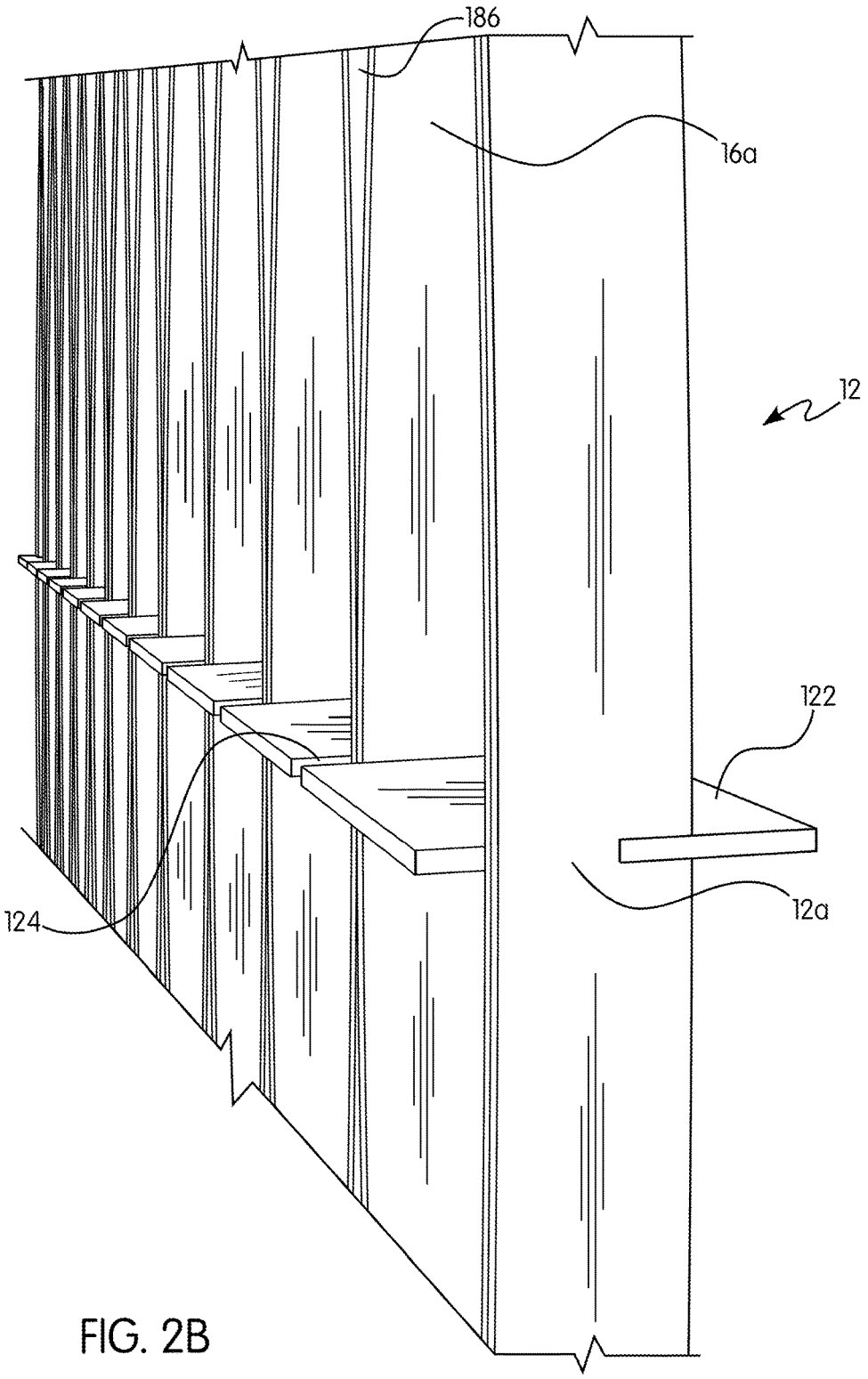
FIG. 2B is an enlarged perspective view of a midportion of the wall partition of FIG. 2A.
Figure 2C:
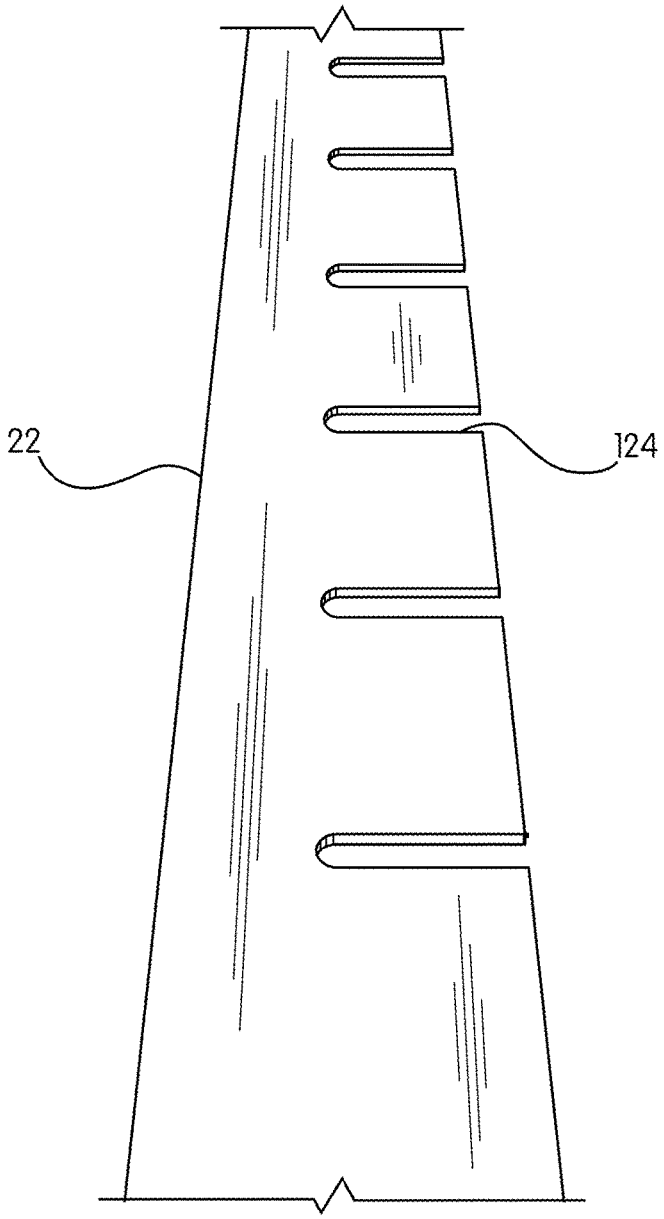
FIG. 2C is an enlarged partial perspective view of a spine of the wall partition of FIG. 2B.

Referring to FIGS. 2A-2C, the architectural structure 10 includes a plurality of slats configured as an expandable structure or expandable honeycomb structure 12. The expandable structure 12 includes a first slat 14, a second slat 16, a third slat 18, and a fourth slat 20. The first slat includes a first major surface 14*a* and a second major surface 14*b* opposite the first major surface. The second slat includes a first major surface 16*a* and a second major surface 16*b* opposite the first major surface. The third slat includes a first major surface 18*a* and a second major surface 18*b* opposite the first major surface. The fourth slat includes a first major surface 20*a* and a second major surface 20*b* opposite the first major surface.

The first and second slats 14, 16 have their respective upper and lower ends connected together. Preferably, the upper end of the first major surface 14*a* of the first slat 14 is connected to the upper end of the second major surface 16*a* of the second slat 16, and the lower end of the first major surface 14*a* of the first slat 14 is connected to the lower end of the second major surface 16*a* of the second slat 16. Specifically, the uppermost end of the first major surface 14*a* of the first slat 14 is aligned with the uppermost end of the second major surface 16*a* of the second slat 16 such that the lateral edges of the slats are aligned or at least one lateral edge is aligned. Likewise, the lowermost end of the first major surface 14*a* of the first slat 14 is aligned with the lowermost end of the second major surface 16*a* of the second slat 16 such that the lateral edges of the slats are aligned or at least one lateral edge is aligned. Thusly joined, the first and second slats 14, 16 have an expandable central or mid-region owing to the flexibility or bendability of the first and second slats.

The third and fourth slats 18, 20 are similarly configured like the first and second slats so as to have their respective upper and lower ends connected together. Specifically, the upper end of the third major surface 18*a* of the third slat 18 is connected to the upper end of the fourth major surface 20*a* of the fourth slat 20, and the lower end of the third major surface 18*a* of the third slat 18 is connected to the lower end of the fourth major surface 20*a* of the fourth slat 20. Thusly joined, the third and fourth slats 18, 20 have an expandable central or mid-region owing to the flexibility or bendability of the first and second slats.

Figure 3A:
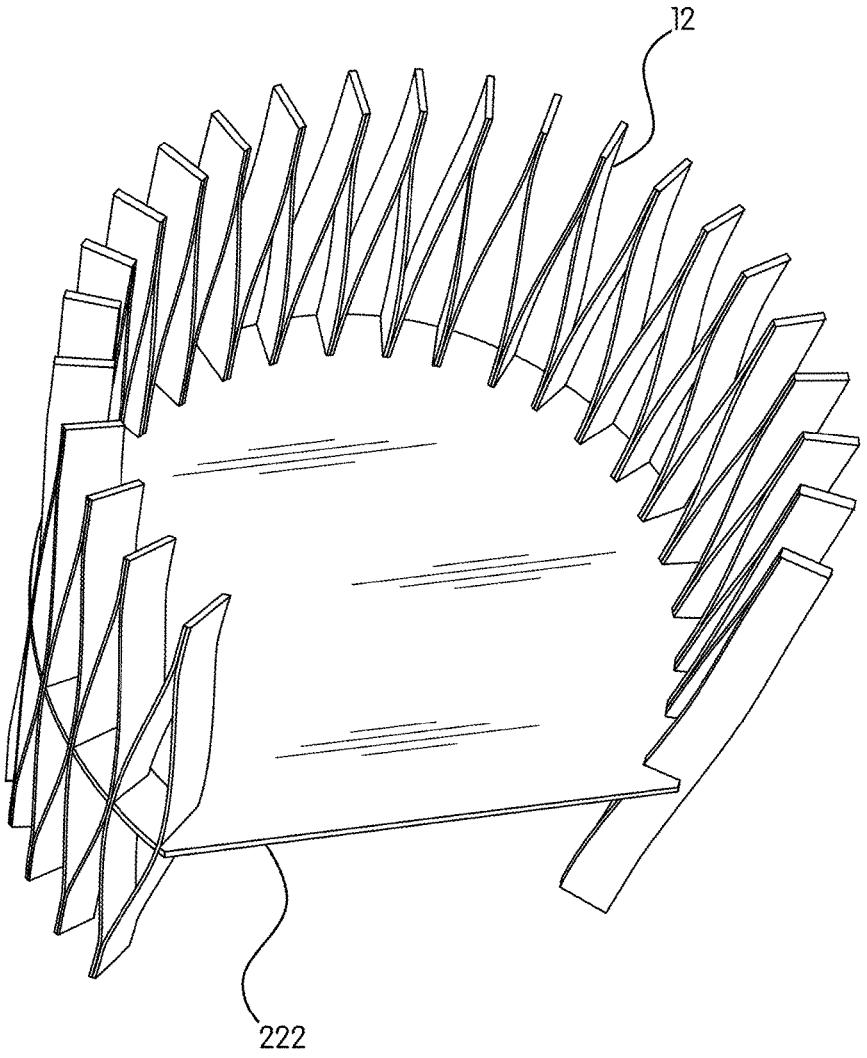
FIG. 3A is a top perspective view of an architectural structure configured as a cubicle having a tabletop in accordance with another preferred embodiment of the present invention.

The second major surface 18*b* of the third slat 18 is connected to the second major surface 16*b* of the second slat 16 about respective central or midportions. Preferably, the second major surface 16*b* is joined with the second major surface 18*b* so as have its lateral edges aligned or at least one of its lateral edges aligned. Alternatively, the second major surface 20*b* of the fourth slat 20 can be connected to the second major surface 16*b* of the second slat 16 or the second major surface 14*b* of the first slat 14 about respective central or midportions. In sum, the configuration of the first, second, third and fourth slats collectively form the expandable structure 12, which is movable between a collapsed position (e.g., FIG. 3B) and an expanded position (FIG. 3A). That is, the adjacent first and second slats 14, 16, and third and fourth slats can flex away from each other to form an expandable honeycomb structure moveable between a collapsed position and an expanded position, see e.g., FIG. 4A.

The first and second slats 14, 16 collectively form paired slat-like members 15 which has its upper ends joined together and its lower ends joined together. The third and fourth slats 18, 20 collectively form another paired slat-like members 19 which has its upper and lower ends joined together. The paired slat-like members 15 also include an expandable central region joined to an adjacent paired slat-like members i.e., paired slat-like members 19. Thus, the expandable structure of the architectural structure comprises a plurality of paired slat-like members.

Alternatively expressed, the expandable structure 12 is formed from a plurality of sections 15'. Each of the plurality of sections 15' includes a first elongate member 14' and a second elongate member 16'. The upper ends and lower ends of the first and second elongate members 14', 16' are joined together. The section 15' is connected to another adjacent section about an expandable central region or midportion 17' of the section. And, as further discussed below, the plurality of sections is connected by a spine about its upper end, a lower end and/or a midportion thereof.

So constructed, the paired slat-like members with its joined upper and lower ends can have its individual slats about its midportion separated from each other owing to the flexible nature or bendability of the individual elongated slats, which are naturally linear when in an unstressed state. That is, the slats are flexible or bendable to a certain degree and once expanded from each other about its midportion, provides a compressive force that is directly inwardly of the paired slat-like members. This induced compressive force allows for a plurality of paired slat-like members when it has its midportions expanded to fixedly self-lock or friction lock onto a slotted spine having a plurality of spaced apart slots or apertures to receive respective midportions, as further discussed below.

Referring back to FIG. 2A, each slat of the expandable structure 12 is preferably configured as a thin flexible elongated member having an overall length L greater than an overall width W. The width, overall length and thickness of the slats can vary depending on the particular use of the architectural structure or desired appearance. For example, the width of the slats of the expandable structure can be about 1, 2, 3, 5, 10, 15, 20, 25, 30, 35, 40, 45, 50 or more centimeters, whereas the overall length of the slats of the expandable structure can be about 0.5, 1, 1.5, 2, 2.5, 3, 3.5, 4, 4.5, 5, 5.5, 6 or more meters. Further, the thickness of the slats can vary from about 1, 3, 5, 10, 15, 20, 25, 30, 40, 50, 60, 70 or more millimeters.

The slats of the expandable structure 12 can be formed from any material suitable for the intended purpose. For example, the slats can be formed from any material having at least a minimal amount of flexibility when configured as a slat to achieve the desired expandable state of the expandable structure. Preferably, the slats are formed from wood (e.g., lauan, solid or veneered wood products), metals (e.g., ferrous or nonferrous metals), polymers (e.g., plastics, polycarbonates), and/or composites (e.g., laminated engineered materials), fiberglass, and carbon fiber.

The slats can be connected or joined together by suitable fasteners e.g., adhesives, hook and loop fasteners, nut and bolts, clamps, tethers, rope, epoxy, and the like. The expandable structure when vertically oriented as shown e.g., in FIG. 2A can be configured to have any desired shape e.g., a serpentine shape (FIG. 1), a curved shape (FIG. 3A) or an S-shape (FIG. 8), because of the flexible plurality of slat-like members which can bend in a direction transverse to a major wall face of the expandable structure. That is, the expandable structure is flexible similar to an accordion.

The architectural structure 10 also includes a base member or spine 22 configured to support the expandable structure 12 in the expanded position or state. In other words, the spine is configured to hold the plurality of paired slat-like members in an expanded state. The base member or spine 22 is preferably configured as an elongated spine, a tabletop, a planar member, a pliable rigid sheet, or a plurality of individual spine members. Of course, the spine can alternatively be configured as any other supporting structure sufficient to support or maintain the expandable structure 12 in the expanded position. For example, the base member is attachable to the honeycomb structure for maintaining the honeycomb structure in the expanded position.

In accordance with an aspect of the present invention, the spine 22 is configured as an elongated spine 122 (FIGS. 2B and 2C) having a plurality of spaced apart apertures 124 for receiving a portion of the expandable structure 12 e.g., a portion of the expandable central region. Preferably, each aperture 124 is sized and configured to receive adjacent slats joined about their respective portions. Further, the elongated spine 122 is preferably positioned about the midportion 12*a* of the expandable structure. The spine can alternatively be connected to the expandable structure or plurality of paired slat-like members about an upper end, a lower end or a midportion thereof.

Figure 2D:
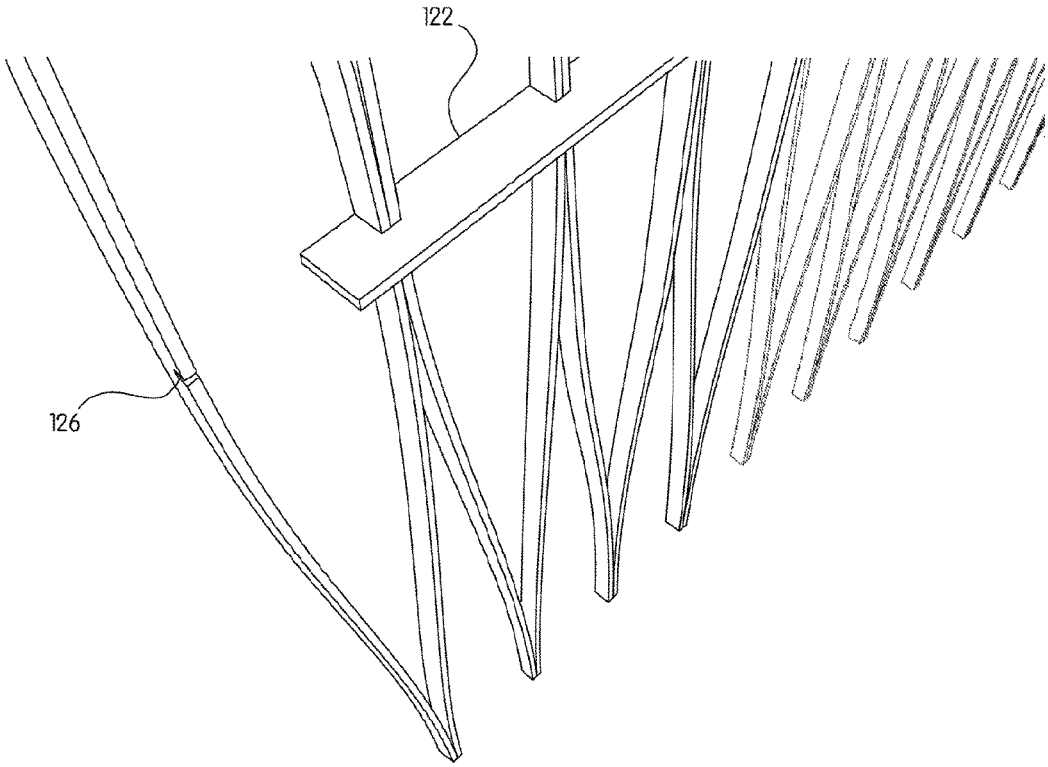
FIG. 2D is an enlarged partial perspective view of a slot joint of the wall partition of FIG. 2B.

Referring to FIG. 2C, the spine 122 can be fabricated with evenly spaced routed fingers 124 which are designed to spread apart the expandable structure 12. The spine 122 is then slipped and locked into place within corresponding slots 126 (FIG. 2D) so as to form a matching interlocking slip type joint joinery or slip joint preventing compressive vertical movement. The slip joint or slip type joinery can be e.g., a slot in joint or cross lap joint or connector elements made of the same or similar structurally competent material which may be milled or fabricated to create slots with widths which are the same or about the same size in width as the vertical support slats or pairs of vertical support slats with matching open slots to receive the spine by slipping the spine into the vertical support slats with a secure friction fit. The spine may be permanently secured with mechanical or adhesive fasteners. Slip type joints to create curved units are created by milling or fabricating the same slip joint joinery into curved continuous spines that are angled to provide the desired diameter of the workstation or wall structure.

The spine provides extended fingers through the outside edge of the expandable structure to allow for the attachment of protective and decorative finishes. Inside extensions of the spine allow for attachment of interior decorative finishes. The spine 22 can be configured to have any predetermined or desired shape.

Figure 4A:
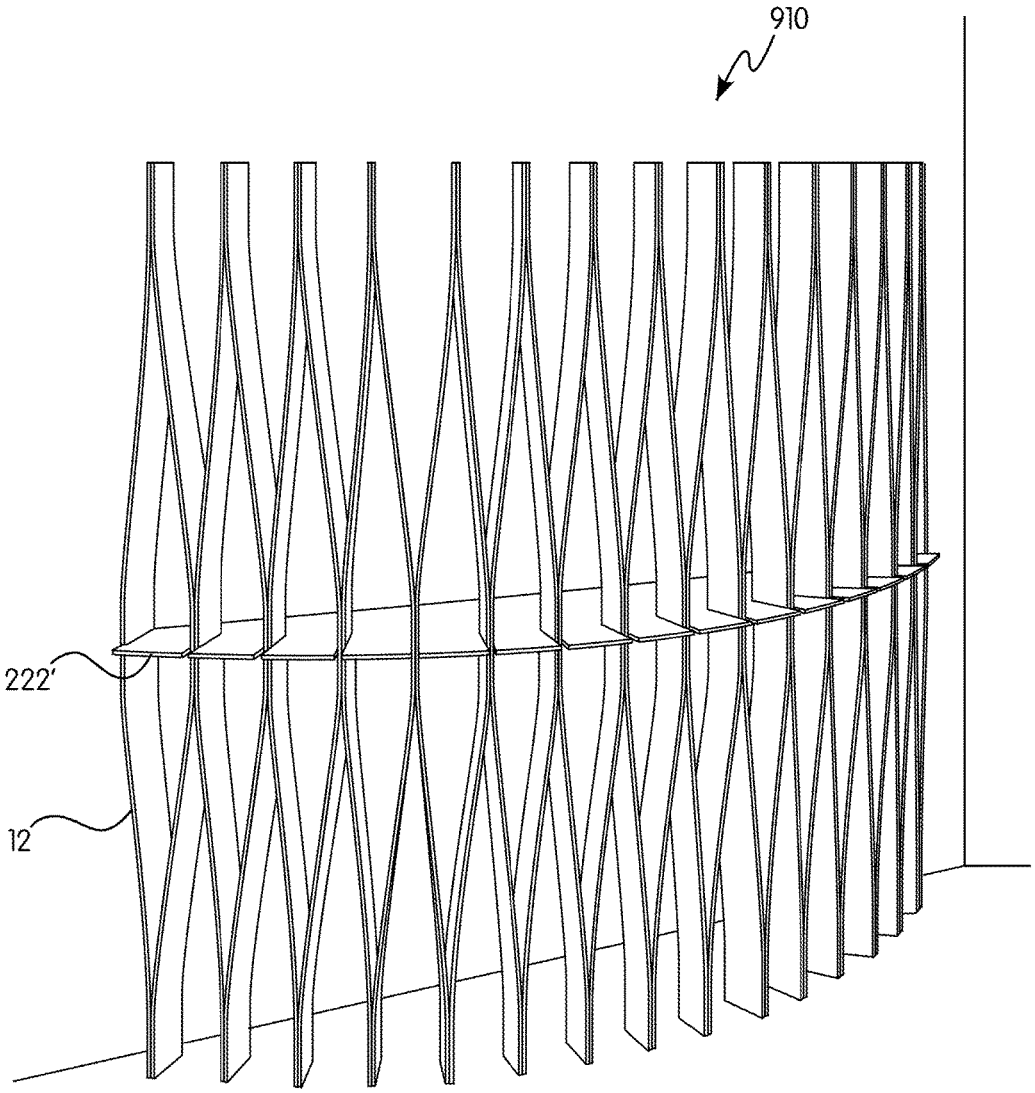
FIG. 4A is a perspective view of an architectural structure configured as a decorative artwork structure in accordance with another preferred embodiment of the present invention.
Figure 5:
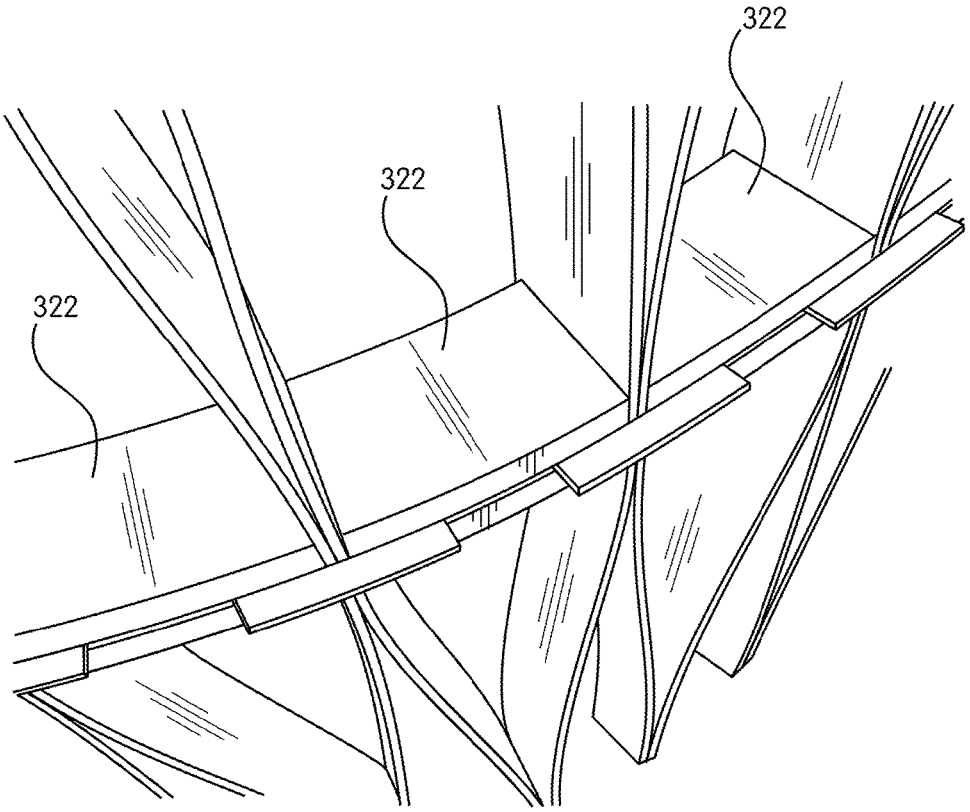
FIG. 5 is an enlarged partial perspective view of a spine of an architectural structure in accordance with another preferred embodiment of the present invention.

In accordance with other aspects of the present invention, the spine can be configured as a curved spine 222, 222' (FIGS. 3A and 4A), or a plurality of individual spine members 322 (FIG. 5). In this configuration, the spine (FIG. 4A) includes a plurality of spaced apart slots that extend along an outer edge of the spine. As shown in FIG. 5, the individual spine members 322 are preferably positioned between the pairs of slats joined about their upper and lower ends i.e., between joined midportions of adjacent slats, to hold the expandable structure in the expanded position.

Figure 7:
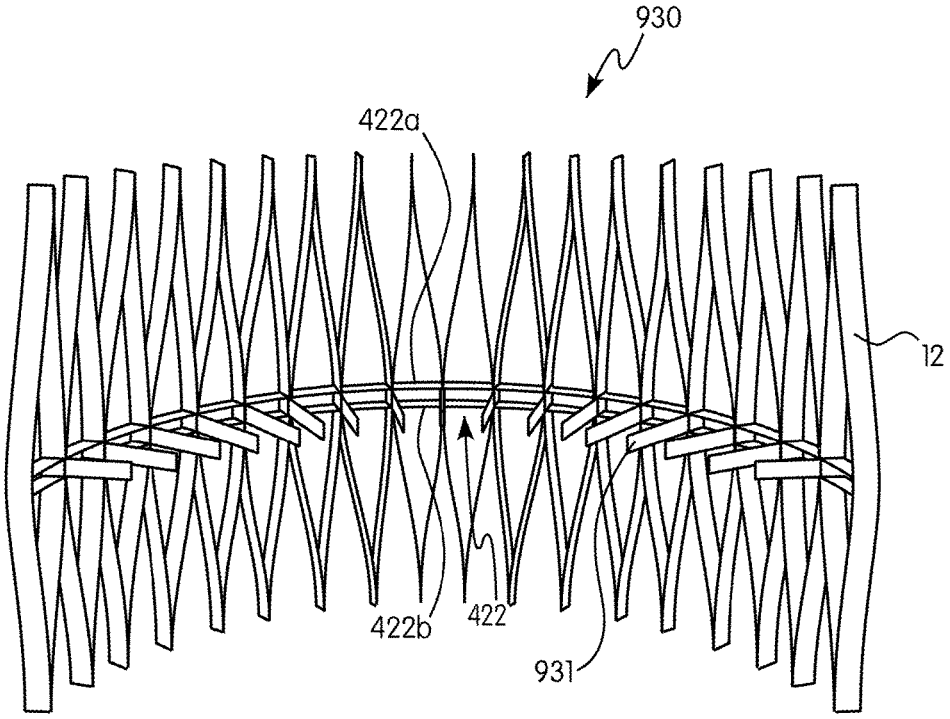
FIG. 7 is a perspective view of an architectural structure configured as a curved partition having inwardly extending mounts in accordance with another preferred embodiment of the present invention.

Referring to FIG. 7, in accordance with another preferred embodiment of the present invention, the spine can be a spine assembly 422 that includes at least a first and a second spine 422*a*, 422*b*. Spines 422*a* and 422*b* are positioned about the midportion of the expandable structure 12 and spaced from each other. In other words, spine 422*a* is configured to assemble to and extend along a width of the expandable structure substantially parallel to the spine 422*b*.

Figure 9:
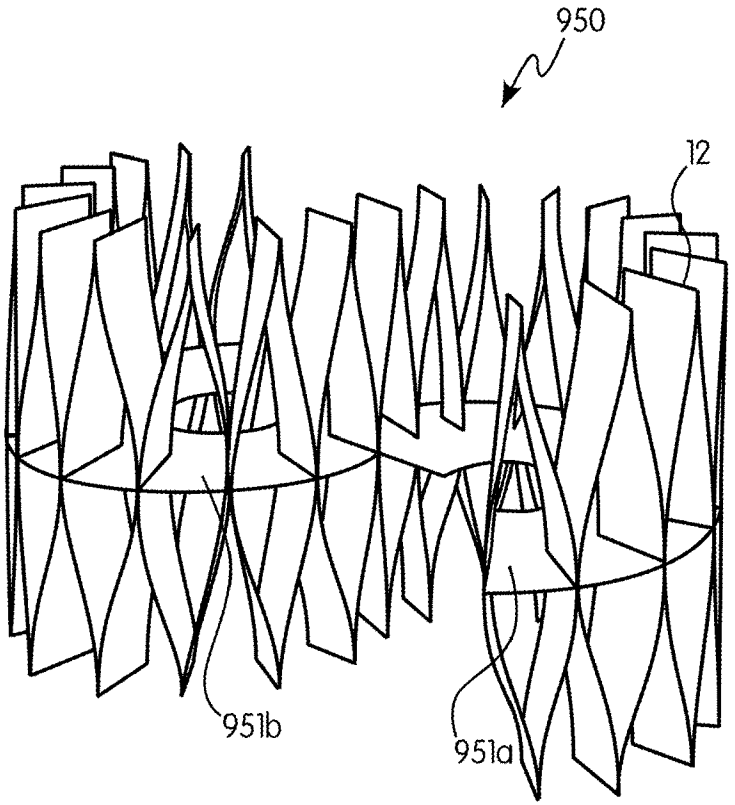
FIG. 9 is a perspective view of an architectural structure configured as a substantially S-shaped artwork piece.

As shown for example in FIG. 9, the spine can be configured to have a width substantially greater than a width of an individual slat or the paired slat-like members.

Figure 3B:
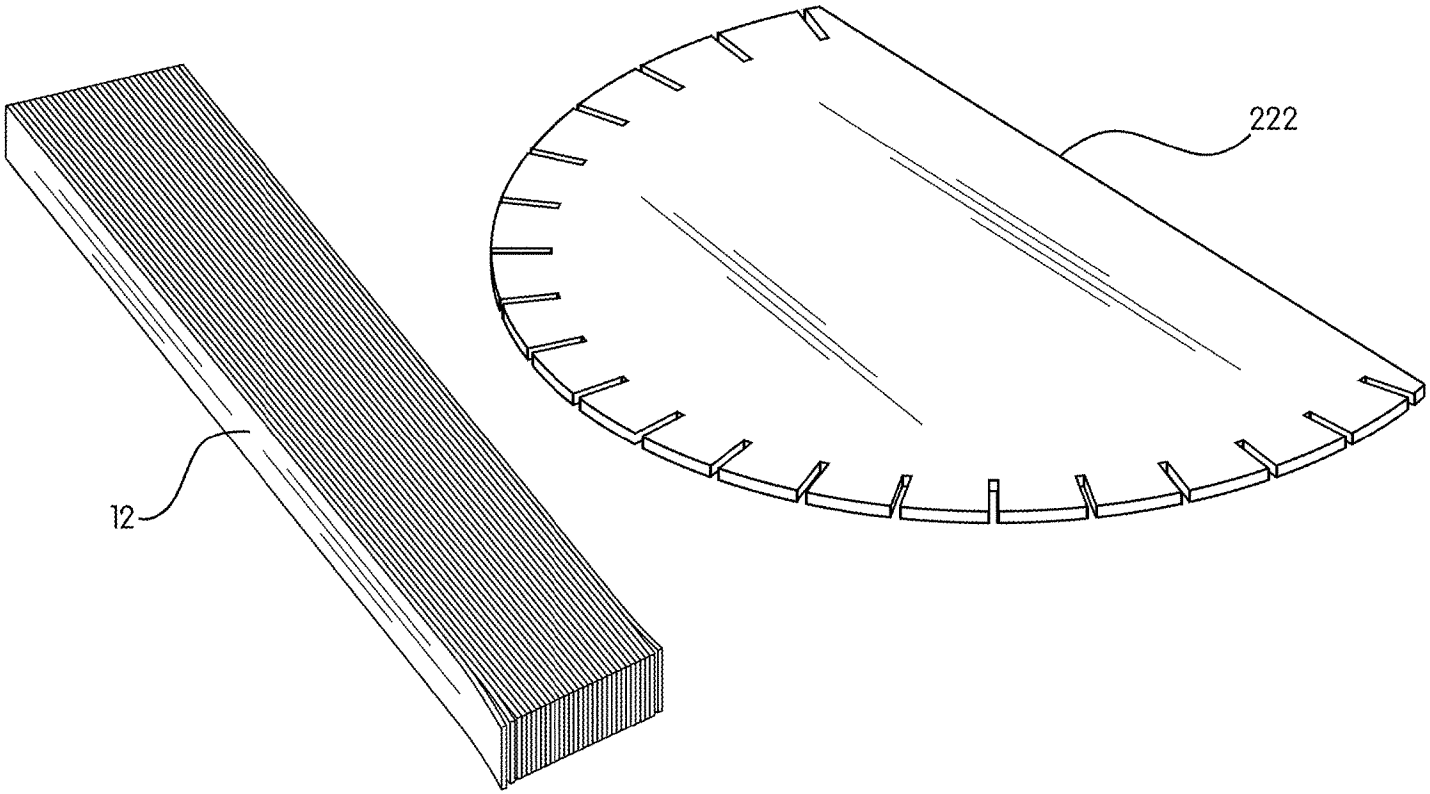
FIG. 3B is a perspective view of the cubicle of FIG. 3A in a disassembled and unexpanded state.

The architectural structure 10 can be used in a variety of ways to create or construct a variety of structural goods. For example, and not by way of limitation, the architectural structure 10 can be used to create cubicles 900, as shown in FIGS. 1 and 3A. Referring to FIG. 3A, the expandable structure 12 is assembled to a spine 222 configured as a curved desk top. The bottom portion of the expandable structure 12 provides support for the desk top spine similar to conventional legs of a desk or table top, while the upper portion of the expandable structure provides a privacy partition. FIG. 3B illustrates the expandable structure 12 in a collapsed state with the spine 222 disassembled from the expandable structure 12.

Figure 4B:
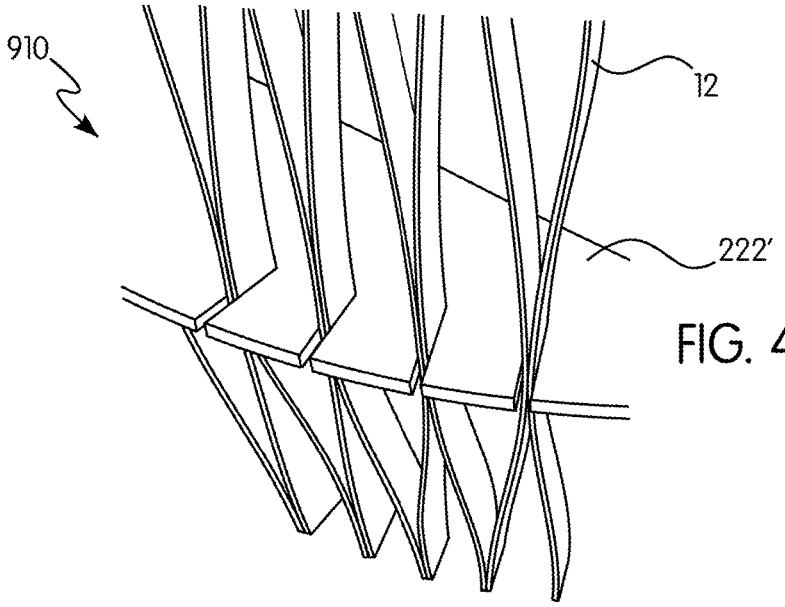
FIG. 4B is an enlarged partial front perspective view of a midportion of the artwork structure of FIG. 4A.
Figure 4C:
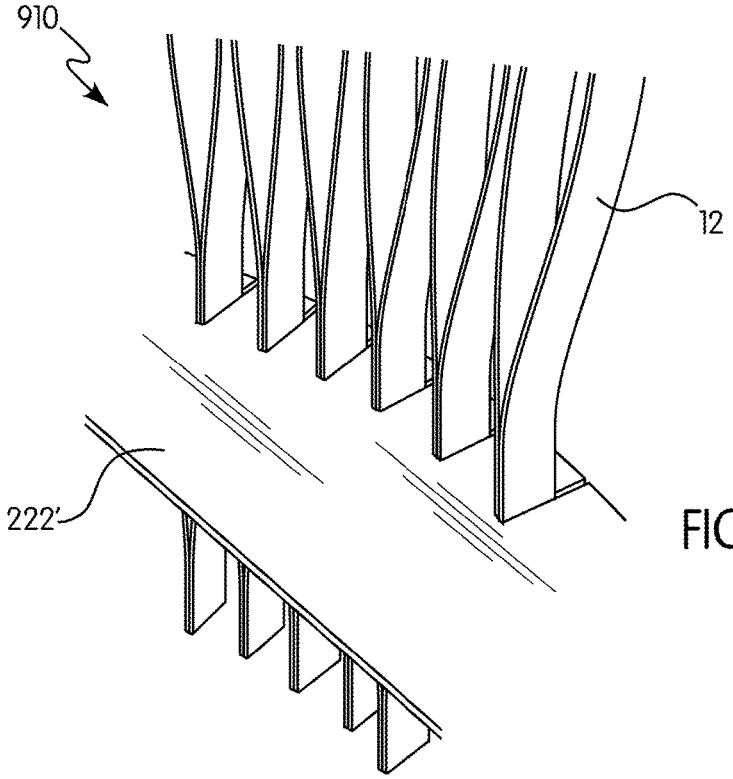
FIG. 4C is an enlarged partial rear perspective view of a midportion of the artwork structure of FIG. 4A.

Referring to FIGS. 4A-4C, the architectural structure can be used to create a decorative upstanding piece of artwork or partition 910. In this embodiment, the spine 222' is configured as a substantially planar member having a curved edge with a plurality of apertures for receiving joined midportions of the expandable structure 12. Owing to the curved nature of the spine, the vertically oriented elongated structure is assembled to the spine in a curved manner such that the partition 910 can be self-supporting in an upright position.

Figure 6:
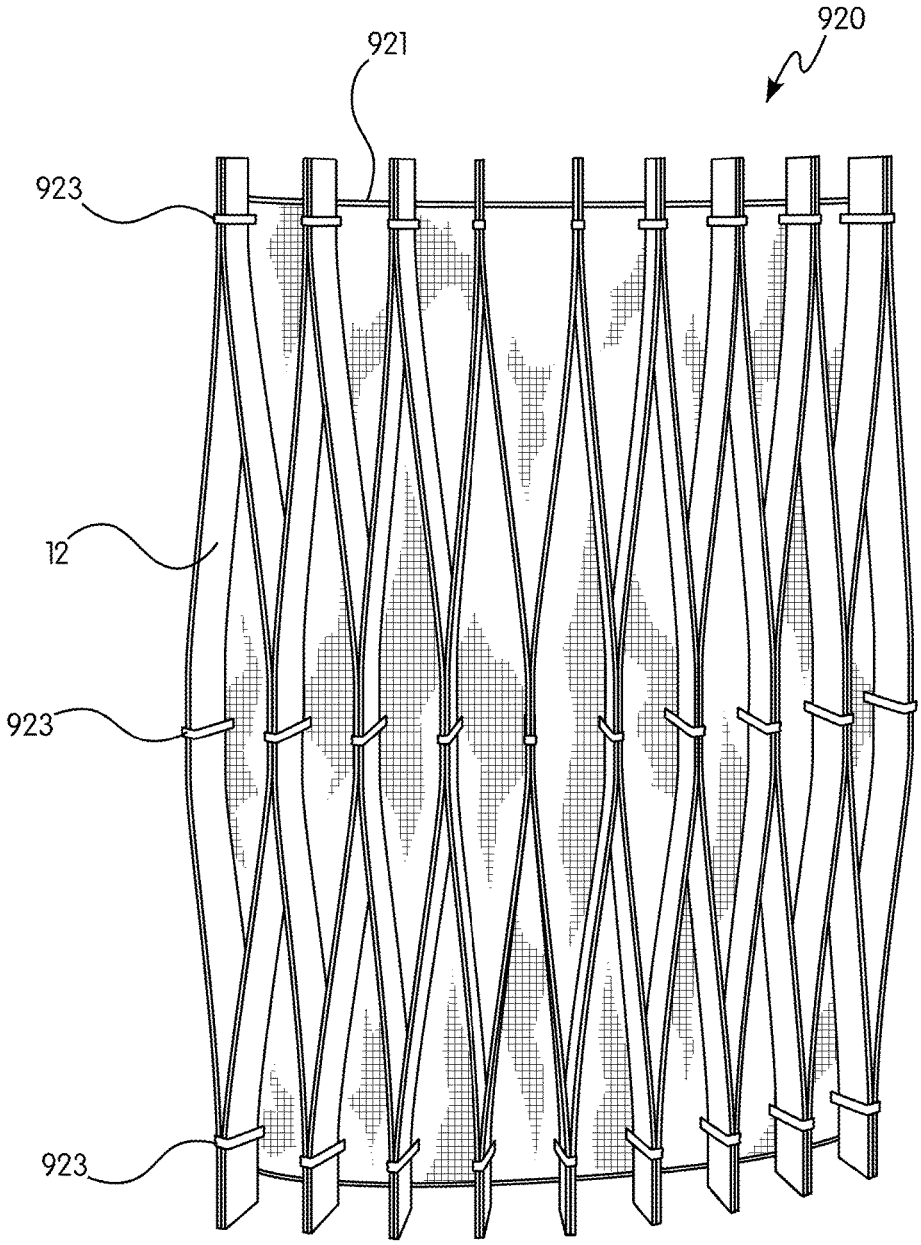
FIG. 6 is a perspective view of an architectural structure configured as a curved partition in accordance with another preferred embodiment of the present invention.

Referring to FIG. 6, the architectural structure can be used to create a partition 920. In this embodiment of the spine 921 is configured as a pliable sheet, and preferably a flexible pliable sheet that can be flexed in a curved manner as shown in FIG. 6. The pliable sheet 921 is attached to the expandable structure 12 by a plurality of fasteners 923 about the elongated structure's upper, lower and midportions. The partition 920 is also a self-supporting partition that can stand upright when configured as a curved partition, as illustrated in FIG. 6.

Referring to FIG. 7, the architectural structure can be used to create artwork or a work station 930. The work station 930 includes spine assembly 422 as discussed above and a plurality of cantilever members 931 extending from the expandable structure 12. Preferably, each of the plurality of cantilever members 931 extends from a midportion or about the spine of the expandable structure, paired slat-like members, or sections. The work station 930 is configured such that the expandable structure 12 is curved and self-supporting such that each of the slats of the expandable structure extend substantially vertically i.e. the expandable structure is in the upright position. Further, the plurality of cantilever members 931 are configured to extend inwardly of the curved expandable structure.

Figure 8:
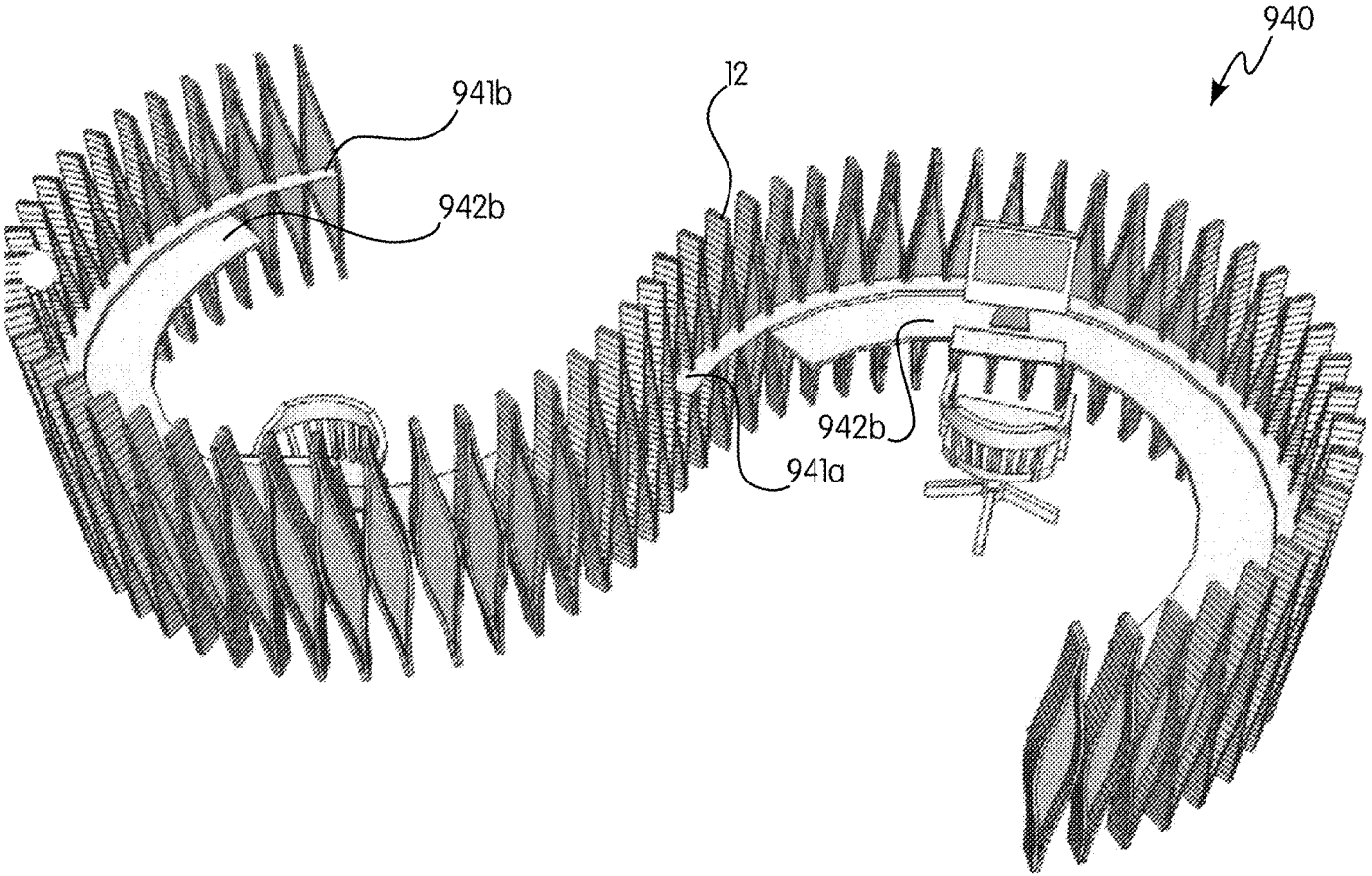
FIG. 8 is a top perspective view of an architectural structure configured as a pair of workstations in accordance with another preferred embodiment of the present invention.

Referring to FIG. 8, the architectural structure can be used to create a multi-unit work station or cubicles 940. The cubicles 940 have an overall S-shaped partition wall formed by the expandable structure 12 which is curved into a substantially S-shaped configuration. The cubicles 940 include a pair of curved spines 941*a*, 941*b*, attached to the expandable structure at opposite ends and opposite sides to form and hold the expandable structure in the substantially S-shaped configuration. Attached to the architectural structure is a pair of substantially C-shaped tabletops 942*a*, 942*b* at respective ends of the expandable structure 12.

Referring to FIG. 9, the architectural structure can be used to create an artwork piece 950. In this embodiment, the expandable structure 12 has slats having a substantial width dimension and is configured in a substantially S-shaped configuration so as to be an upright self-supporting artwork piece. The artwork piece 950 includes a pair of C-shaped spines 951*a*, 951*b* attached to the expandable structure at opposite ends and opposite sides to hold the expandable structure in the substantially S-shaped configuration.

Figure 10:
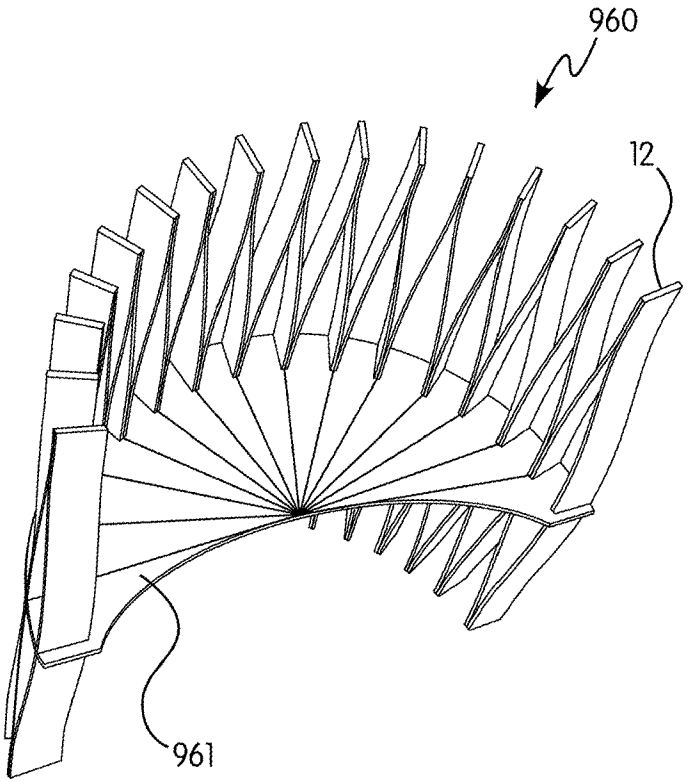
FIG. 10 is a perspective view of an architectural structure configured as a partition having a shelf.

Referring to FIG. 10, the architectural structure can be used to create an artwork piece or work station 960. In this embodiment, the expandable structure 12 is arranged in a substantially C-shaped configuration. The work station 960 also includes a curved spine 961 configured, as shown in FIG. 10, forming a work top. The curved spine 961 includes a plurality of apertures about an edge for attaching to the expandable structure 12.

Figure 11:
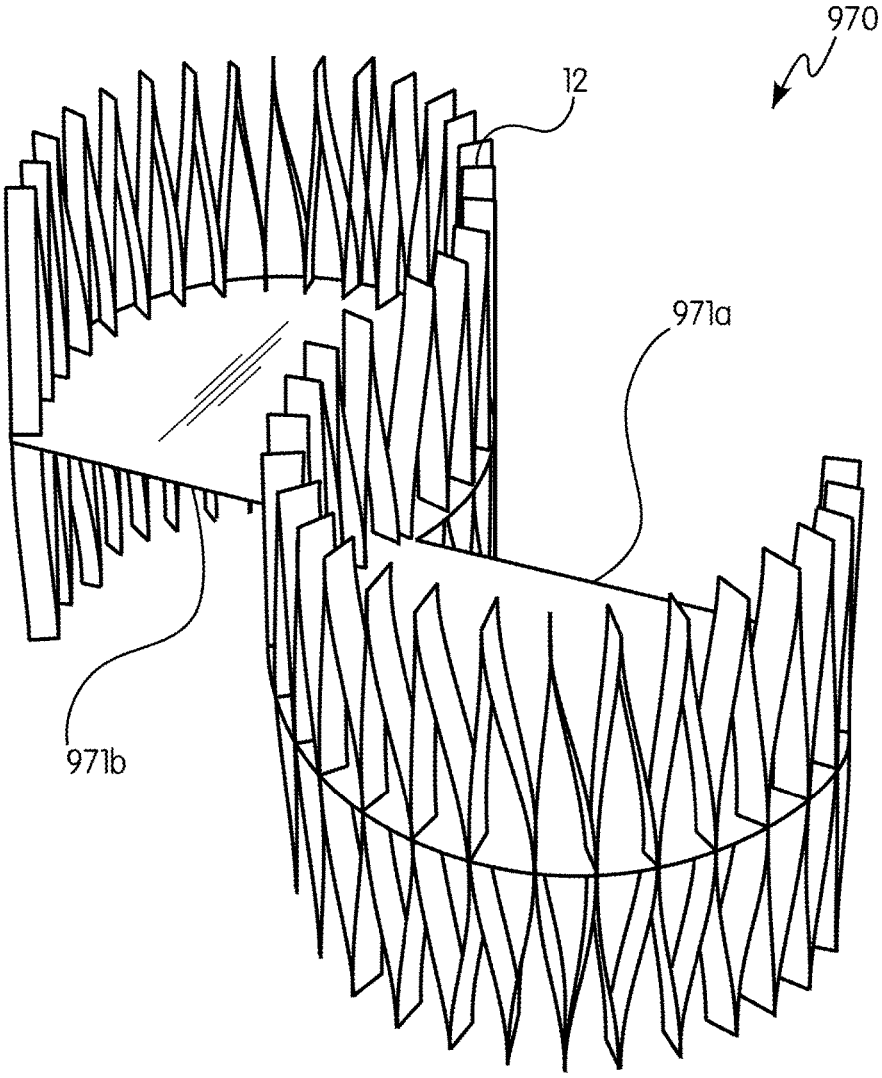
FIG. 11 is a perspective view of an architectural structure configured as a pair of cubicles in accordance with another preferred embodiment of the present invention.

Referring to FIG. 11, the architectural structure can be used to create a multi-unit work station or cubicles 970. In this embodiment, the expandable structure 12 is arranged in a substantially S-shaped configuration. The cubicles 970 also include two curved tabletop spines 971*a*, 971*b* each having a plurality of spaced apart apertures along its outer curved edge for receiving respective joined midportions of the expandable structure 12. The cubicles 970 are self-supporting with the bottom or lower portions of the expandable structure functioning as the table legs for the tabletop spine.

Figure 12:
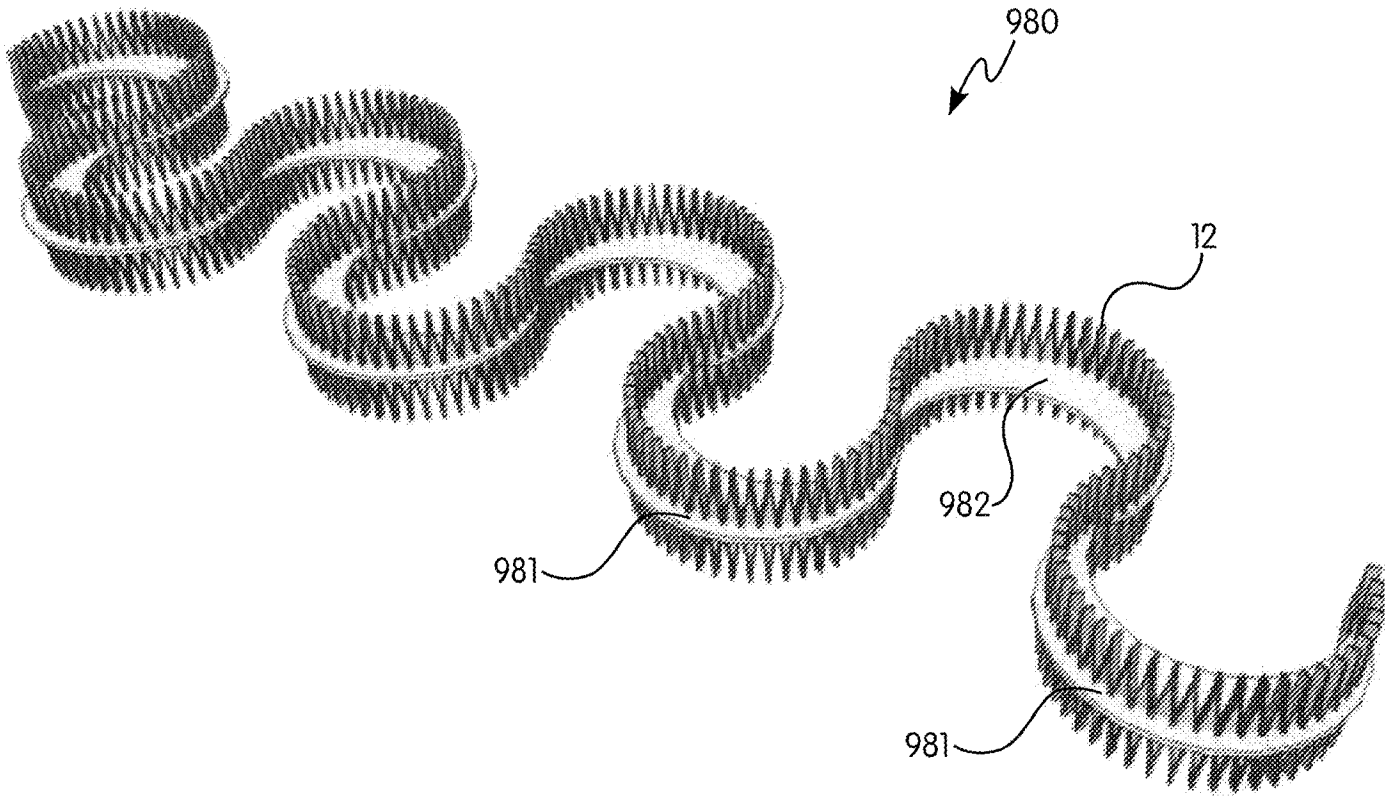
FIG. 12 is a perspective view of an architectural structure configured as a series of workstations connected in a serpentine-like fashion in accordance with another preferred embodiment of the present invention.

Referring to FIG. 12, the architectural structure can be used to create a multi-unit work station 980. In the configuration shown, the multi-unit work station includes eight workstations each partitioned by the expandable structure 12. The expandable structure 12 is arranged or configured as a series of substantially S-shaped structures wherein each work station includes a tabletop 982 about an inner region of each S-shaped portion of the expandable structure. The multi-unit work station 980 also includes a plurality of substantially C-shaped spines 981 having a plurality of spaced apart slots along its curved edge configured to hold the expandable structure in the substantially S-shaped configuration. The spines 981 are arranged along the expandable structure in series about the expandable structure's midportion. Each substantially C-shaped spine 981 is preferably positioned to an adjacent C-shaped spine 981 about a point of inflection of the S-shaped configuration.

Figure 13:
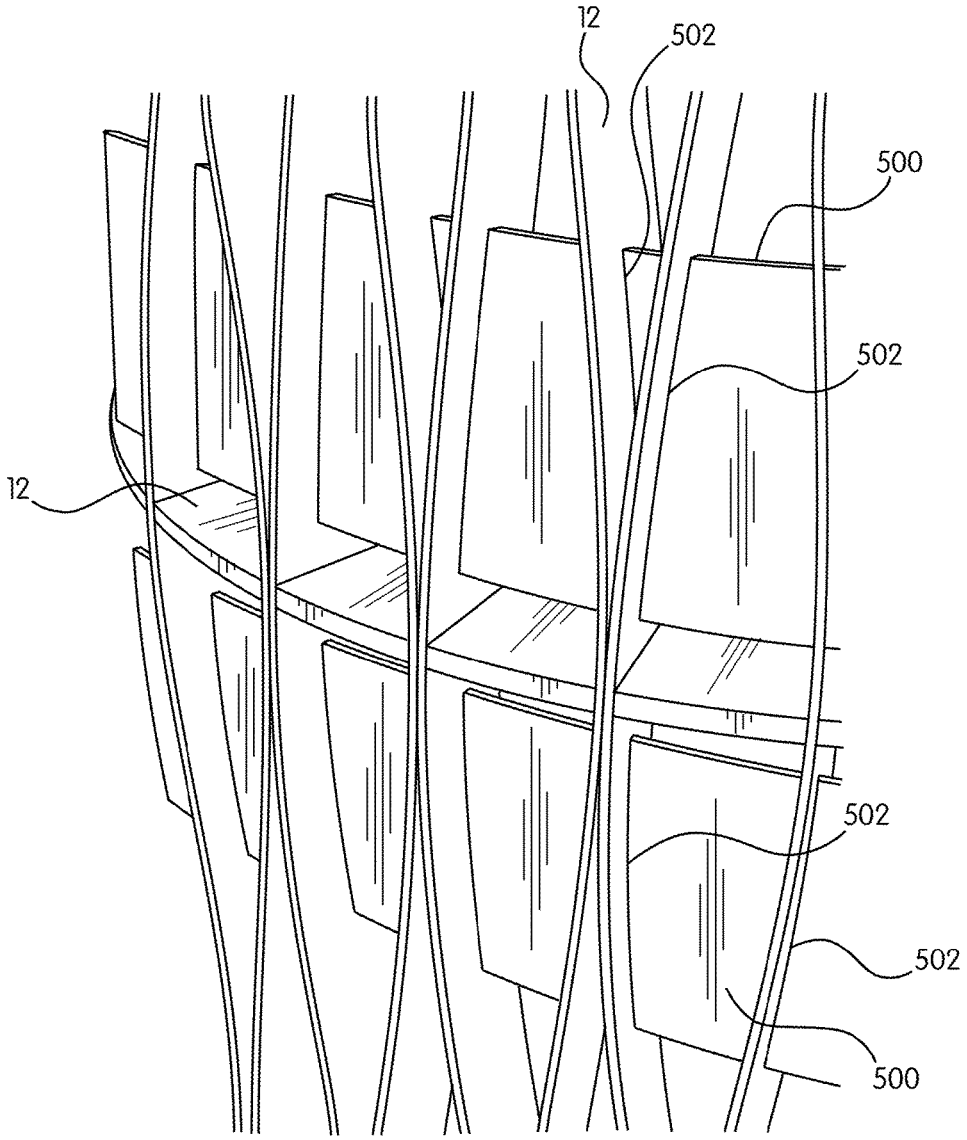
FIG. 13 is a partial perspective view of an architectural structure having a binding sheet in accordance with another preferred embodiment of the present invention.

Referring to FIG. 13, in accordance with another preferred embodiment of the present invention, the architectural structure includes a binding sheet 500. The binding sheet facilitates maintaining the expandable structure, the expandable honeycomb structure or plurality of paired slat-like members or sections in the expanded state/position. The binding sheet 500 is configured as a thin flat sheet having a width that can vary to suit a particular need or structure or overall width of the expandable structure 12. The binding sheet 500 also has a height that is preferably smaller than one half the overall height of the slats forming the expandable structure.

The binding sheet 500 is configured to be received within elongated slots 502 formed within the individual slats of the expandable structure 12. The elongated slots 502 can be formed along a predetermined section of the expandable structure or along the entire width of the overall expandable structure 12. With the binding sheet 500 inserted within the elongated slots, the binding sheet provides frictional resistance and rigidity to the fully assembled architectural structure. The binding sheet 500 also adds an additional layer of privacy when the architectural structure is used e.g., as a partition or a work station cubicle.

Preferably the binding sheet 500 is assembled to the expandable structure about a position above and below the spine 22. The binding sheet also advantageously facilitates joining of multiple sections of the expandable structure so as to form e.g., multiple workstations or connection of multiple partitions.

The binding sheet 500 induces a spring action to a flat sheet within the curved expandable structure above and below the spine within predesigned and routed slots 502 within the expandable structure to create enough frictional resistance to add a moderate level of rigidity to the full assembly to help resist lateral movement. The binding sheet may also extend into an adjacent unit to bind multiple units together.

The binding sheet 500 can be made from any material suitable for its intended purpose. However, the binding sheet is preferably formed from the same material as the expandable structure e.g., wood (e.g., lauan), metals, polymers (e.g., plastics), and/or composites.

Figure 14A:
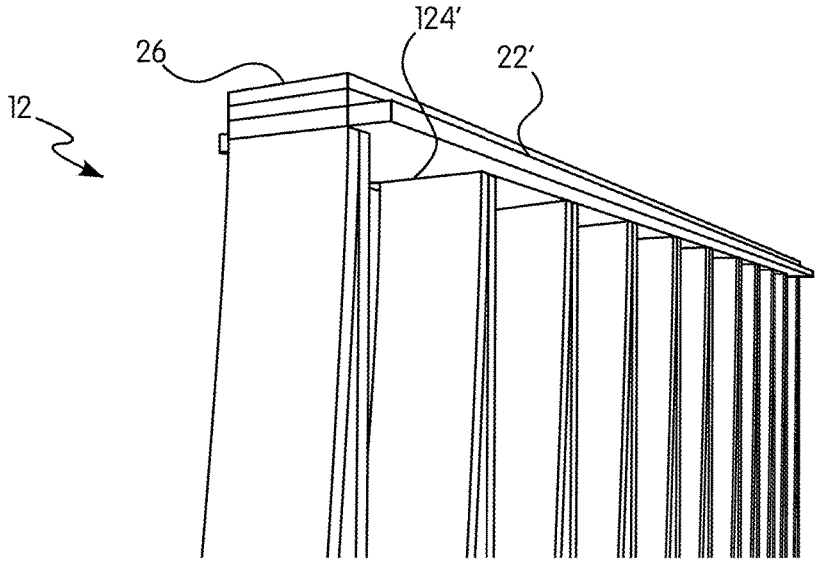
FIG. 14A is a partial perspective view of an architectural structure configured as a wall partition having a top spine assembly in accordance with another preferred embodiment of the present invention.
Figure 14B:
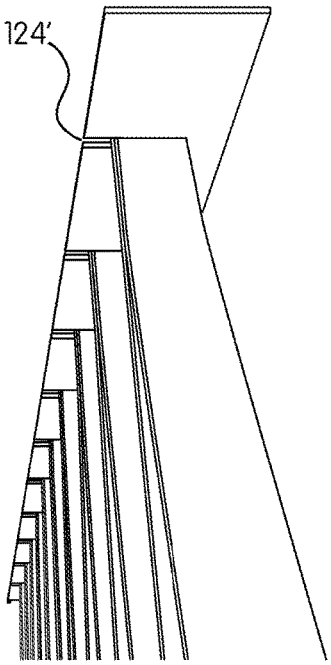
FIG. 14B is another partial perspective view of the top spine assembly of FIG. 14A from an opposite side of the wall.
Figure 14C:
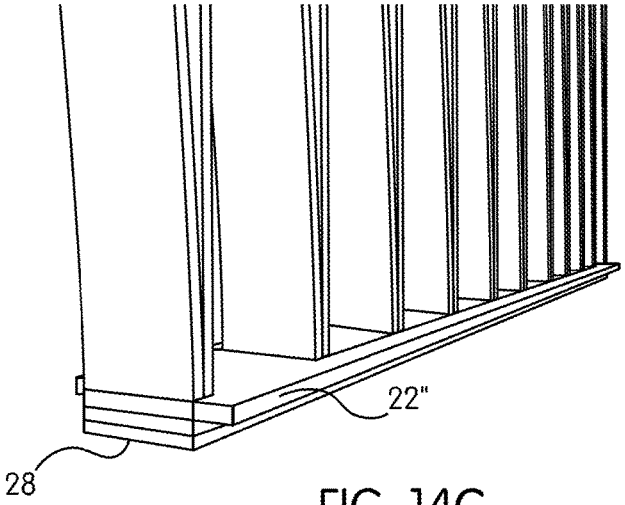
FIG. 14C is a partial perspective view of a bottom half of the wall partition of FIG. 14A.

Referring to FIGS. 14A-14C, in accordance with yet another preferred embodiment of the present invention, the architectural structure includes a second spine 22' and a third spine 22". The second spine 22' can be attached to the upper or top end of the expandable structure 12 or plurality of sections for supporting or maintaining the joined upper ends of the slats in an expanded state. In accordance with an aspect of the present embodiment, the second spine 22' can be configured with a plurality of spaced apart apertures 124' for receiving joined upper ends of the slats forming the expandable structure 12. The third spine 22" is similarly configured as the second spine 22' but attached to the lower or bottom end of the expendable structure or plurality of sections for supporting or maintaining the joined lower ends of the slats of the expandable structure in the expanded state. The second and third spine can each include a slip-type joint, as shown e.g., in FIG. 2D.

Additionally, the architectural structure 10 includes a top plate 26 and a bottom plate 28. The top plate 26 is configured as an elongated plate for attachment to the upper end of the expandable structure 12 and the second spine 22', as shown in FIG. 14A. The bottom plate 28 is similarly configured as the top plate 26 but attached to the lower end of the expendable structure and the third spine 22".

Preferably, the top and bottom plates 26, 28 are configured as bearing plates and formed from any material suitable for its intended purpose. For example, the top and bottom plates can be formed from materials including but not limited to wood (e.g., pressure treated marine grade plywood), metals, composites, polymers (e.g., plastics), or other corrosive resistant materials, especially materials capable of accepting adhesives.

The second and third spines are fabricated with evenly spaced spines and routed fingers or slots designed to spread apart the expandable structure. The second and third spines are each slipped and locked into place with matching interlocking slip type joinery on the expandable structure.

Two structurally competent bearing plates are then secured to second and third spines respectively, with either structural adhesives or weather resistant mechanical fasteners. The second and third spines extend its fingers through the outside edge of the expandable structure to allow for attachment of protective and decorative finishes Referring to FIGS. 15A-15B, in accordance with another aspect of the present invention, the architectural structure 10' includes a top cap 30 for capping a top most end of joined upper slat ends and a base or base cap 32 for capping a bottom most end of joined lower slat ends of the expandable structure 12, or each paired slat-like members or sections. The top cap and base 30, 32 are preferably configured as an elongated cap having a substantially U-shaped longitudinal cross-section for receiving either the upper or lower joined ends of the slats of the expandable structure 12.

Figure 15A:
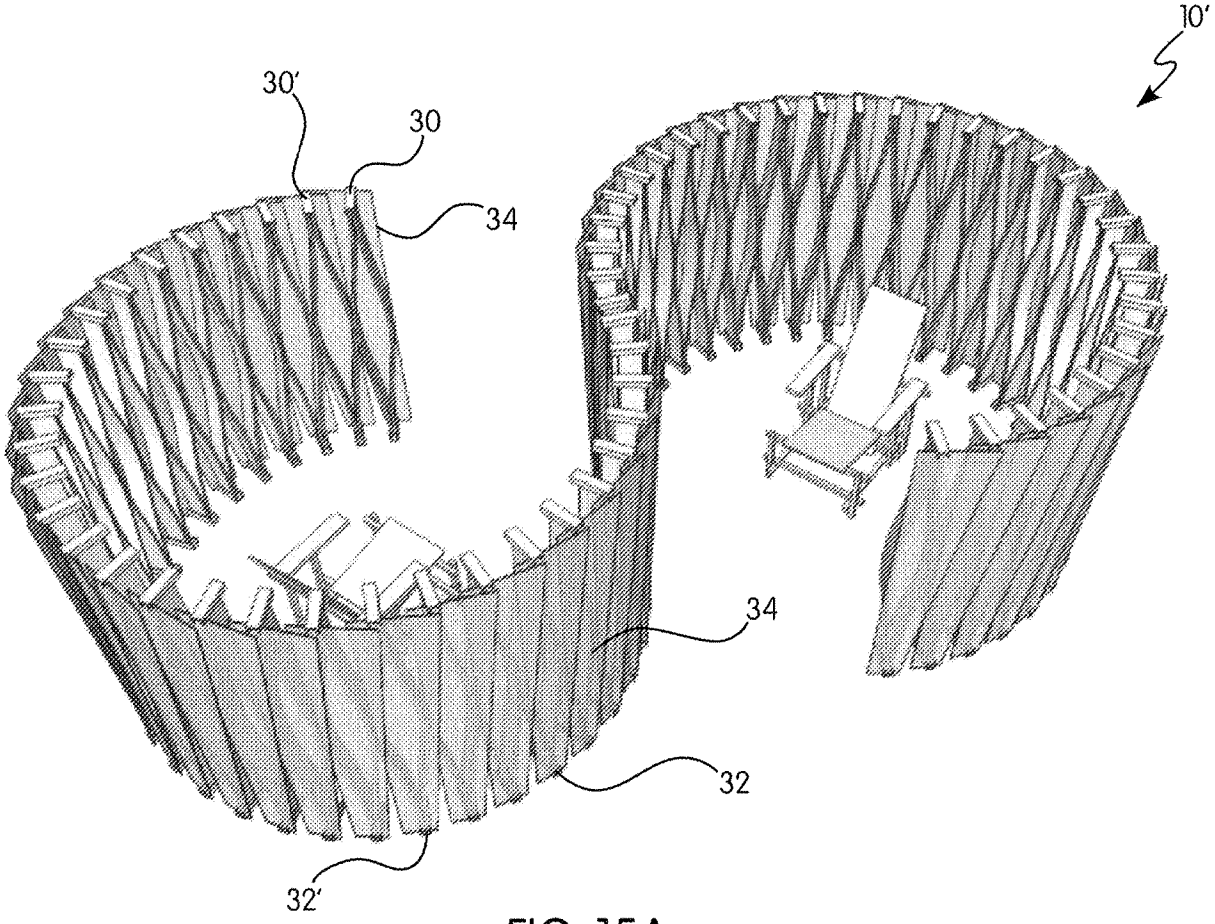
FIG. 15A is a perspective view of an architectural structure configured as a substantially S-shaped partition having a plurality of cover members.

In accordance with another aspect of the present embodiment, each of the top cap and base are configured as a bracket 30', 32' for supporting a vertical panel or vertical blind 34. The vertical panel 34 is preferably configured, as best shown in FIG. 15A, having and overall trapezoidal shape.

Collectively, the bracket and panel form a panel assembly. The bracket is attached to one of the plurality of paired slat-like members, sections, or joined upper ends of the first and second slats, and the panel is connected to the bracket.

Figure 15B:
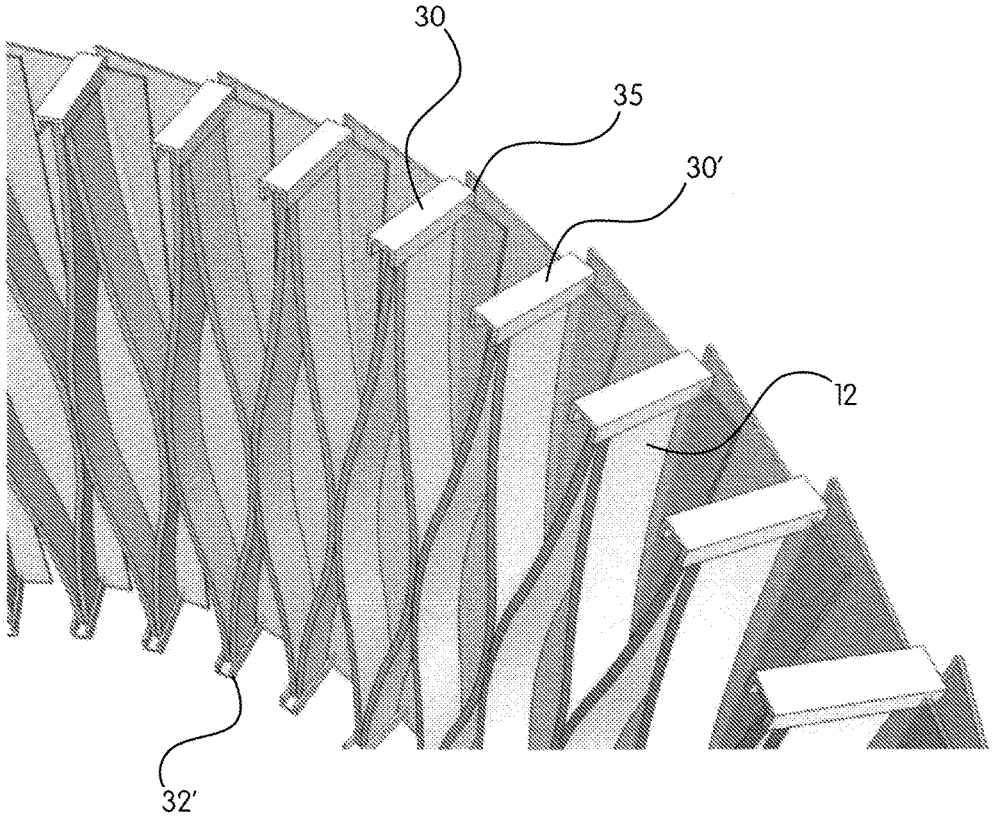
FIG. 15B is an enlarged partial perspective view of the partition of FIG. 15A.

Preferably, each vertical panel 34 is sized to have an overall width greater than a width between the joined upper or lower ends of individual slats of the expandable structure 12. In this manner, the vertical panels 34 can be assembled to the expandable structure in an overlapping configuration, as shown in FIGS. 15A and 15B. In sum, the architectural structure includes a plurality of vertical blinds connected to respective paired slat-like members, sections, expandable structure, or expandable honeycomb structure.

Alternatively, owing to the trapezoidal shape of the vertical panel 34, a top end of the vertical panel can be sized to have a width greater than a width between the joined upper ends of individual slats of the expandable structure. Additionally, the vertical panel 34 has a lower end sized to have a width smaller than a width between the joined lower ends of individual slats of the expandable structure 12.

Each of the top and bottom brackets 30', 32' are configured with a fastener 35 for securing an individual vertical panel 34 to a pair of top and bottom brackets. Preferably, the fastener is configured as a slot sized and configured to receive either a top or bottom edge of the vertical panel 34 in a press-fit manner to securely hold the vertical panel in a fixed position.

Figure 16:
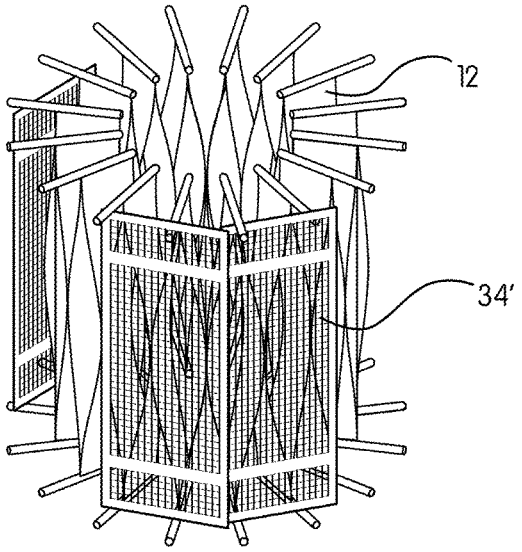
FIGS. 16-18 are perspective views of an architectural structure configured as an artwork display in accordance with various preferred embodiments of the present invention.

Referring to FIG. 16, in accordance with another aspect of the present embodiment, the vertical panel can be configured as a mesh-like vertical panel 34', configured as shown in FIG. 16. Specifically, e.g., the mesh-like vertical panel 34' has a substantially rectangular shape having an overall height substantially the same as the expandable structure 12 and a width substantially greater than a width between an adjacent paired slat-like members of the expandable structure. Further, the mesh-like vertical panel includes a mesh pattern.

Figure 17:
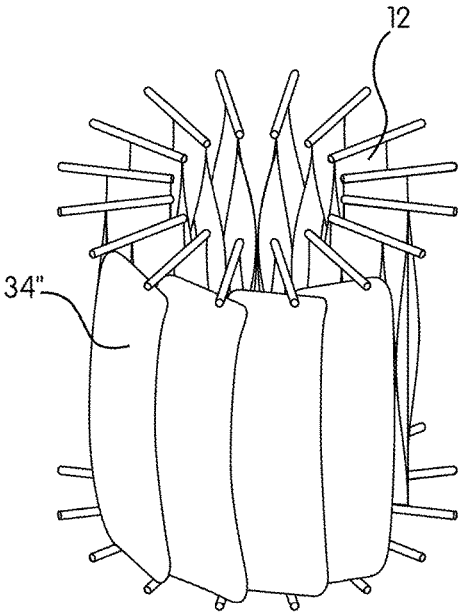

Referring to FIG. 17, in accordance with another aspect of the present embodiment, the vertical panel can be configured as a curved vertical panel 34". The curved vertical panel 34" is configured with an overall height greater than an overall height of the expandable structure 12 such that when the upper and lower ends of the curved vertical panel 34" are attached to the upper and lower ends of the expandable structure, a midportion of the curved vertical panel curves outwardly, as shown in FIG. 17. Each curved vertical panel is shown to be a rectangular panel, but can alternatively be configured as any other shaped panel e.g., a trapezoidal, a square, a circular, or a triangular panel, and the like.

Figure 18:
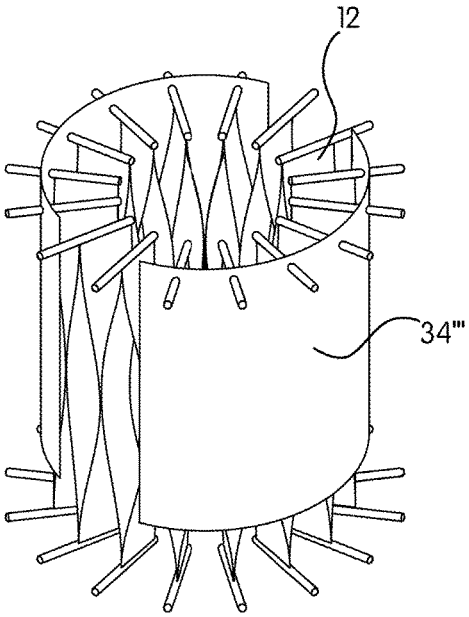

Referring to FIG. 18, in accordance with another aspect of the present embodiment, the vertical panel can be configured as an elongated unitary panel 34'". The elongated unitary panel 34'" can be configured e.g., to have an overall height no greater than an overall height of the expandable structure and a width substantially greater than a width between the adjacent joined upper or lower ends of individual slats of the expandable structure. Preferably, the elongated unitary panel 34'" is configured to have an overall length greater than e.g., two pairs of paired slat-like members, such as a width of about 3, 4, 5, 6, 7, 8, 9, 10, 11, 12 or more paired slat-like members.

Figure 19A:
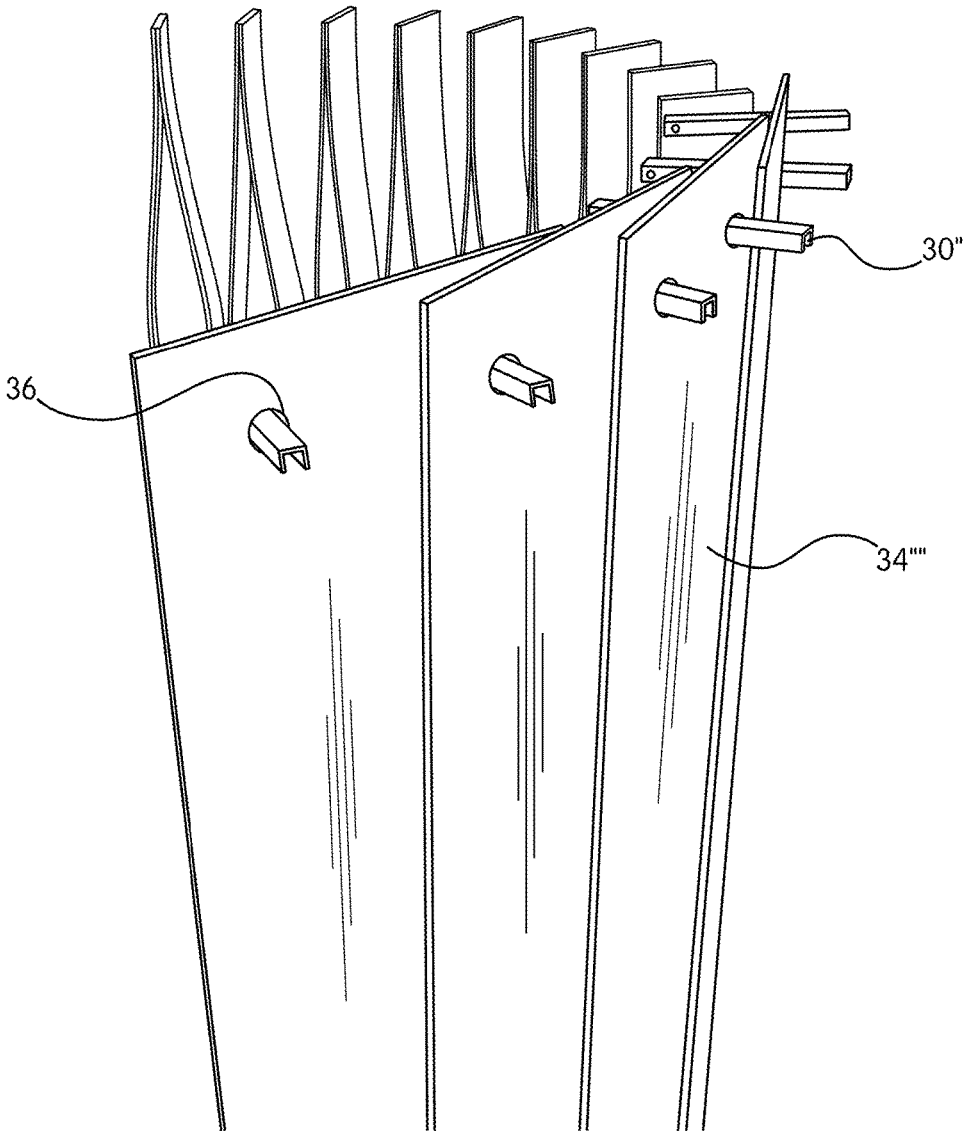
FIG. 19A is a partial perspective view of an architectural structure configured as a cubicle having a plurality of cover members in accordance with another preferred embodiment of the present invention.
Figure 19B:
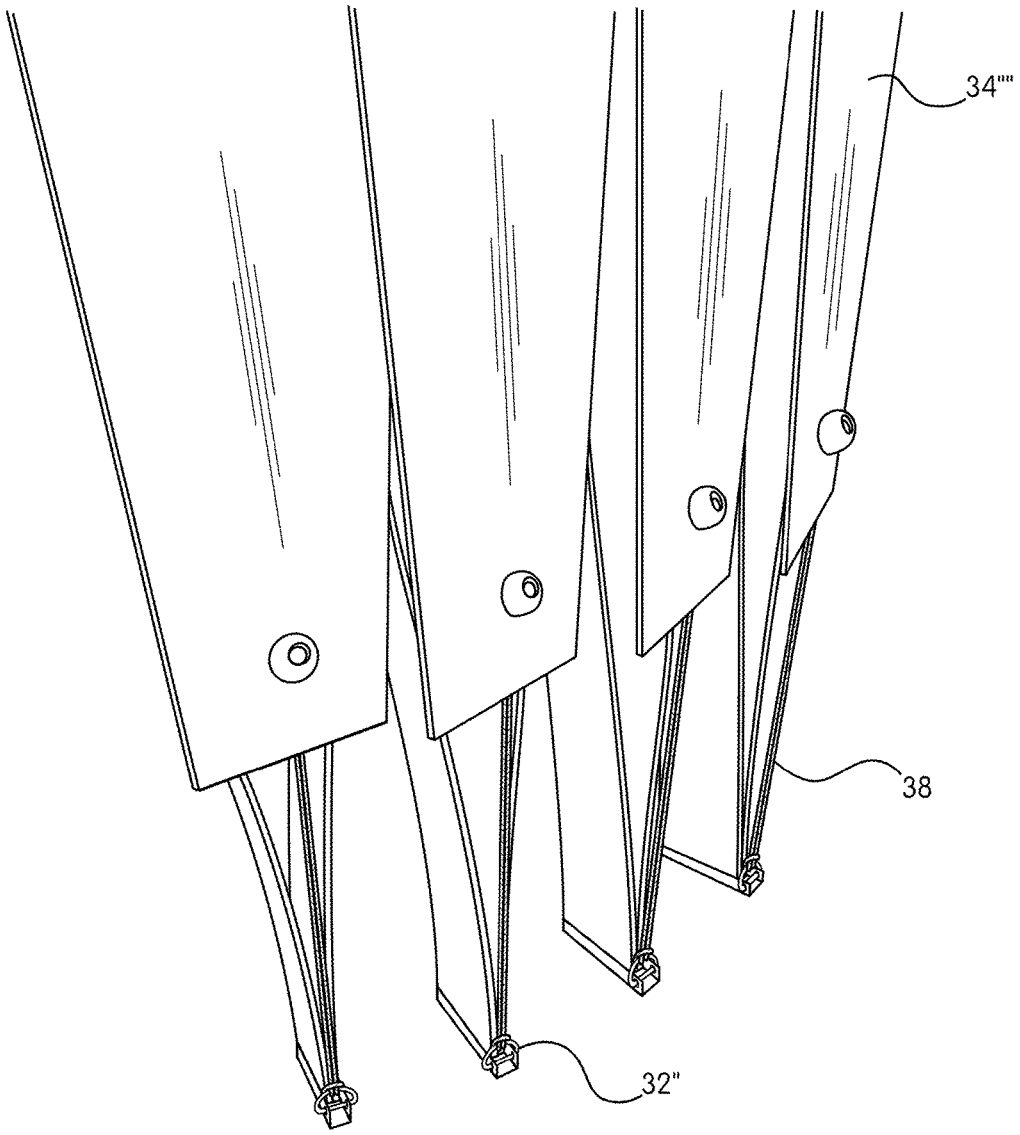
FIG. 19B is a partial perspective view of a bottom portion of the cubicle of FIG. 19A.

Referring to FIGS. 19A and 19B, in accordance with another aspect of the present embodiment the vertical panel 34'" can be configured similarly to vertical panel 34, but with an overall height smaller than an overall height of the expandable structure 12. In this embodiment, a top end of the vertical panel 34'" is attached to brackets 30" via a through hole 36 about an upper end of the vertical panel.

Referring to FIG. 19B, the lower end of the vertical panel is spaced from the lowermost end of the expandable structure and includes a tether 38 for securing the lower end of the vertical panel to a base bracket 32". Alternatively, the tether 38 can be for example, but not limited to, a rope, a chain, a linkage, a spring, an actuator, and the like.

In sum, the panel or skin assembly can be custom-designed and self-installed with overlapping panels placed over structural extensions attached to the top and bottom of the expandable structure 12 and then tethered with an elastic band assembly to rings attached to the structural extensions of the bottom of the expandable structure.

Figure 20A:
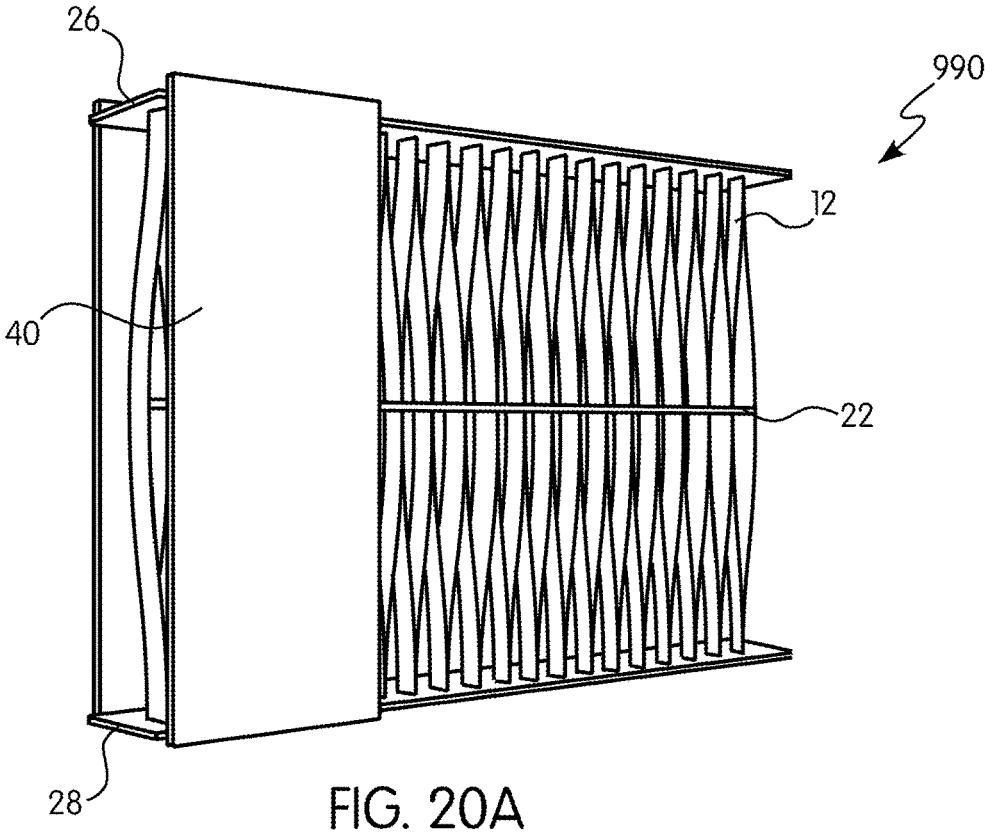
FIG. 20A a perspective view of an architectural structure configured as a wall having a cover member in accordance with another preferred embodiment of the present invention.
Figure 20B:
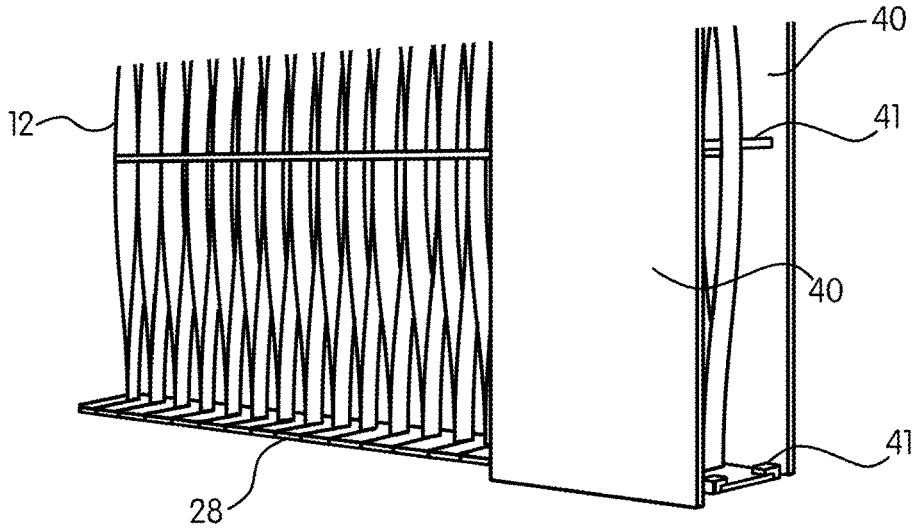
FIG. 20B is a partial perspective view of a bottom portion of the wall of FIG. 20A.

Referring to FIGS. 20A, 20B, in accordance with another preferred embodiment, the present invention provides an architectural structure configured as a partition or wall 990. The wall 990 includes the expandable structure 12 arranged in a linear fashion so as to form a planar wall or partition.

The wall further includes a spine 22 about the midportion of the expandable structure to support and maintain the expandable structure in the expanded state. The spine 22 is preferably configured to have a width greater than an overall with of the spendable structure so as to have a shelf portion available e.g., for supporting and providing access for electrical and plumbing needs.

The wall further includes top and bottom plates 26, 28. Alternatively, the wall can optionally include second and third spines (not shown) about respective upper and lower ends of the expandable structure.

Furthermore, the wall includes a cover 40 covering a side of the expandable structure 12, or plurality of paired slat-like members or sections. As shown in FIG. 20A, the side of the expandable structure 12 that is covered is substantially transverse to the first and second slats and face a direction transverse to a facing direction of the major surfaces of the first and second slats. In other words, the cover covers a side of the expandable structure i.e., a major side of the expandable structure that is substantially transverse to the major surfaces of the first and second slats.

The cover 40 is preferably configured to have an overall height and width substantially matching the overall height and width of the expandable structure. Alternatively, the cover instead of being a unitary cover can be a segmented cover for covering one or both major sides of the expandable structure. The cover is also attached about its upper and lower ends to the top and bottom plates 26, 28, respectively. The cover 40 can be attached to the wall by appropriate fasteners 41, e.g., screws, clips, adhesive, clamps, and the like.

The cover 40 can be made from any material suitable for its intended purpose. For example, but not limited to, the cover can be made from wood (e.g., finished plywood panels), polymers (e.g., sheet plastic), composites, fiberglass, metals (e.g., stainless steel), and the like, such as translucent materials, weather resistant materials, textiles, and the like.

Additionally, the architectural structure includes a top plate 26 and a bottom plate 28. The top plate 26 is configured as an elongated plate for attachment to the upper end of the expandable structure 12 similar to that shown in FIG. 14A. The bottom plate 28 is similarly configured as the top plate 26 but attached to the lower end of the expendable structure.

Figure 21:
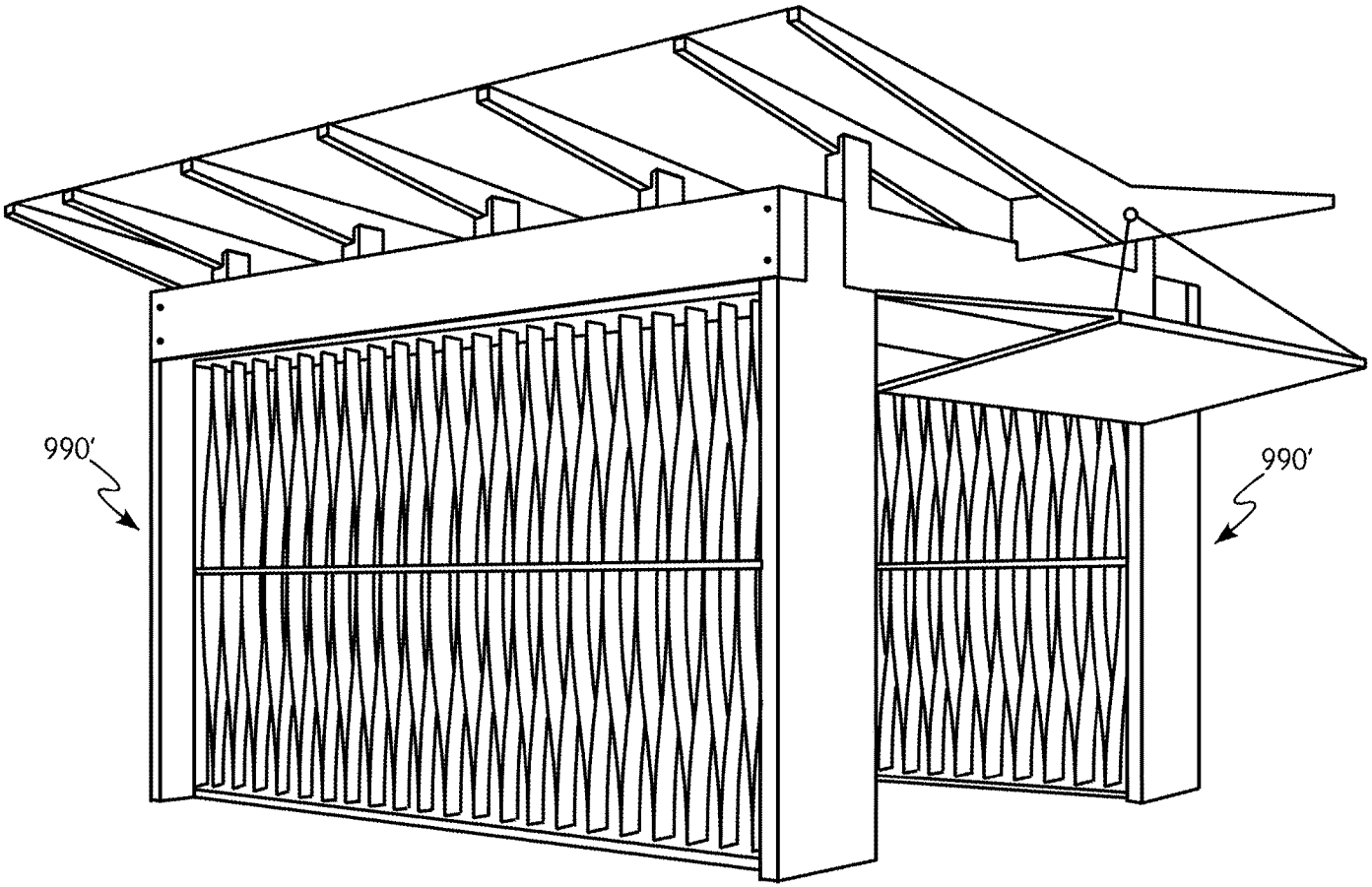
FIG. 21 is a perspective view of an architectural structure configured as a building structure in accordance with another preferred embodiment of the present invention.
Figure 22:
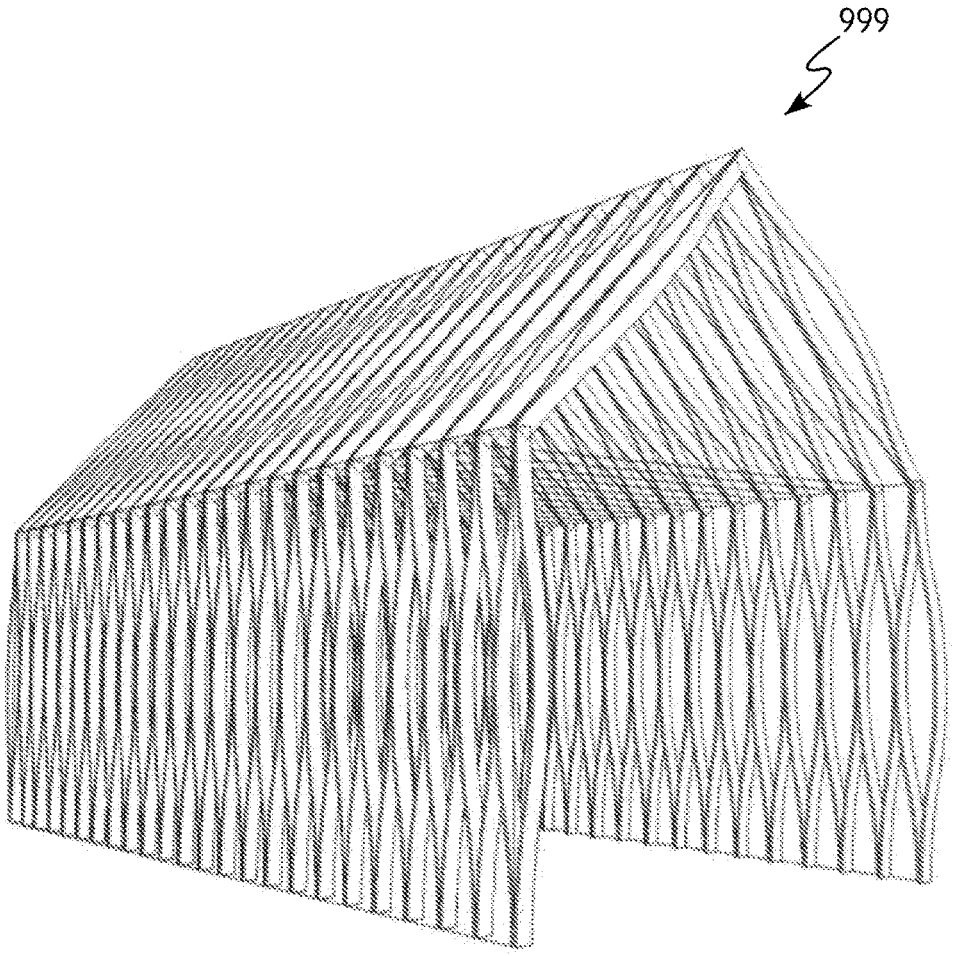
FIG. 22 is a perspective view of an architectural structure configured as a building frame structure in accordance with another preferred embodiment of the present invention.

In accordance with another aspect of the present invention, the architectural structure can be configured as building material for manufacturing a wall 990' of a building, as shown in FIG. 21. The structure illustrated in FIG. 21 can be e.g., a small surgical room/office/living room that is constructed of plywood frame segments with structural foam. The frame segments are then inserted between bearing ends and then translucent plastic is applied to let light filter in. Alternatively, the architectural structure can be used in the construction of an entire building frame 999 including the walls and roof, as shown in FIG. 22.

Figure 23A:
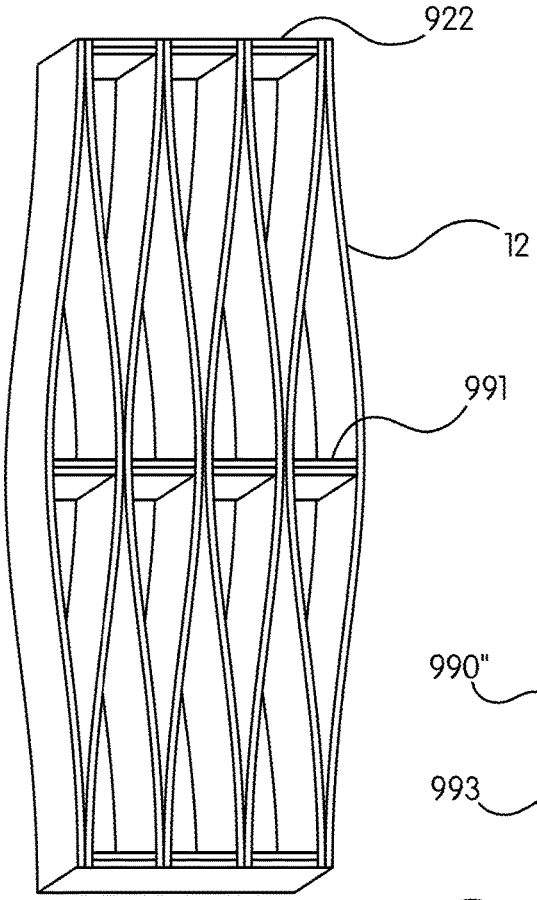
FIG. 23A is a perspective view of an architectural structure configured as a wall without insulation in accordance with another preferred embodiment of the present invention.
Figure 23B:
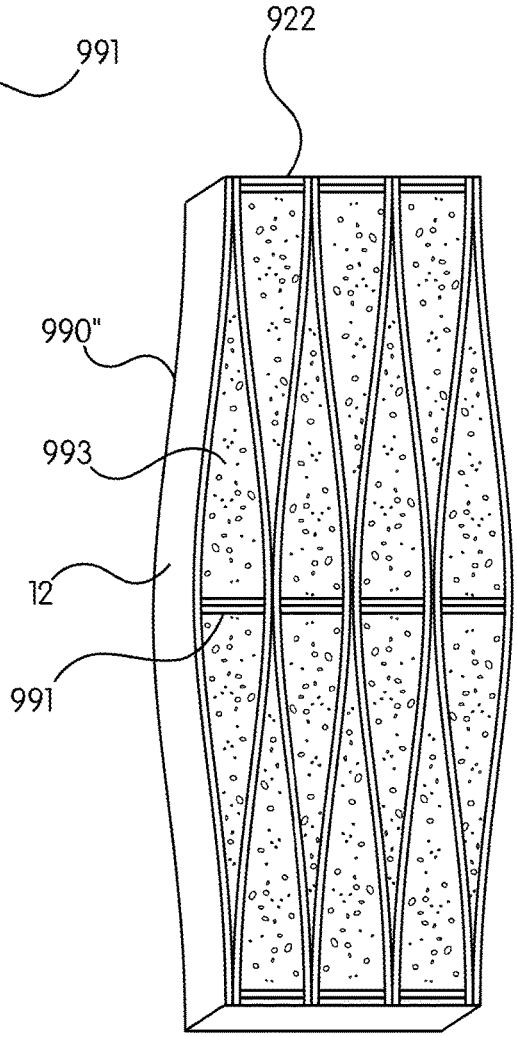
FIG. 23B is a perspective view of the wall of FIG. 23A having insulation.

Referring to FIGS. 23A and 23B, in accordance with another aspect of the present invention, the architectural structure can be configured as an insulated wall 990". The wall 990" is preferably configured with a first spine 991 comprising a plurality of individual spine members configured to hold the plurality of paired slat-like members or sections in the expanded state. The first spine 991 is positioned about a midportion of the expandable structure 12. The wall further includes a second spine 992 about an upper end of the expandable structure and a third spine 993 about a lower end of the expandable structure. Preferably, each of the second and third spines comprise a plurality of individual spine members configured to hold the respective joined upper and lower slats in the expanded state. Owing to the nature of the spine comprising a plurality of individual spine members, the wall 990" can be configured to have a substantially flat first and second major wall surfaces.

The wall 990" also includes insulation 993 positioned between individual slats e.g., the first, second, third and fourth slats, of the expandable structure or paired slat-like members, between first and second elongate members of the plurality of sections, or between wall sections of the expandable honeycomb structure. The insulation can be any conventional insulation such as, but not limited to, fiberglass insulation, foam insulation, expandable foam insulation, sand, and the like. Preferably, the insulation is expandable rigid foam insulation such that the expandable foam insulation provides rigid support and aids in providing rigid structure to the overall wall 990".

The wall 990" forms a thermal wall that may be used to construct emergency shelters, permanent or nonpermanent residential dwellings, permanent or nonpermanent commercial or public occupied space, which may use the thermal wall for environmental, visual or acoustical control. Because of the inherent sustainable nature and structurally competent nature of the plywood manufacturing process, insulation qualities of the foam insulation and the reduction of processed materials, the system is inherently environmentally efficient and less expensive than traditional wood frame assemblies. The system can be shipped to a site in an expanded state so as to form a compressed flat packed package for reduced shipping costs. Upon receipt, the system can be assembled and locked into place with the structural spine along with the top and bottom bearing transfer assemblies to a designed length and the insulation installed thereafter for full competency. The system may also be manufactured as a predetermined or predesigned panel system in environmentally controlled conditions for consistency and delivered in bulk as needed.

Figure 25A:
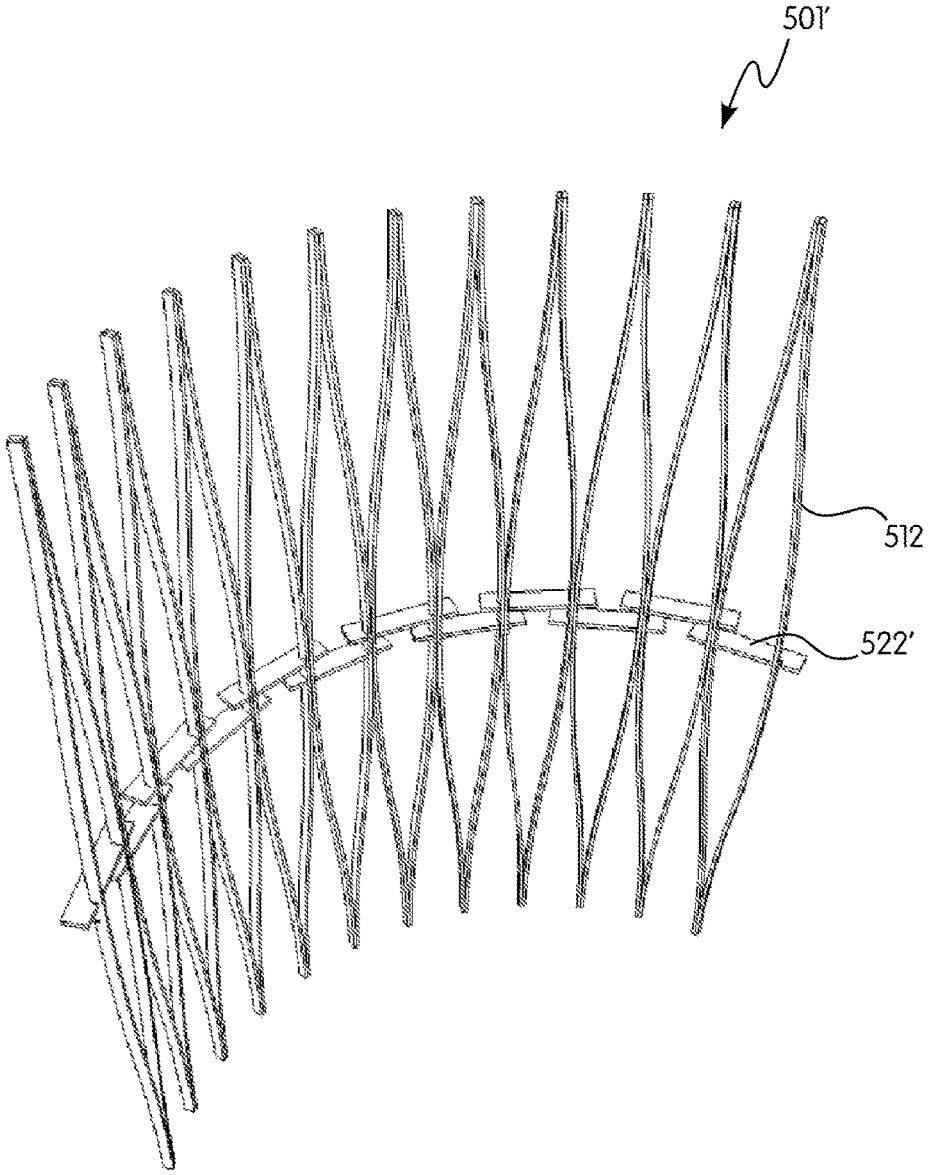
FIG. 25A is a perspective view of an architectural structure configured as a curved vertical wall partition having a plurality of spine members in accordance with another preferred embodiment of the present invention.
Figure 25B:
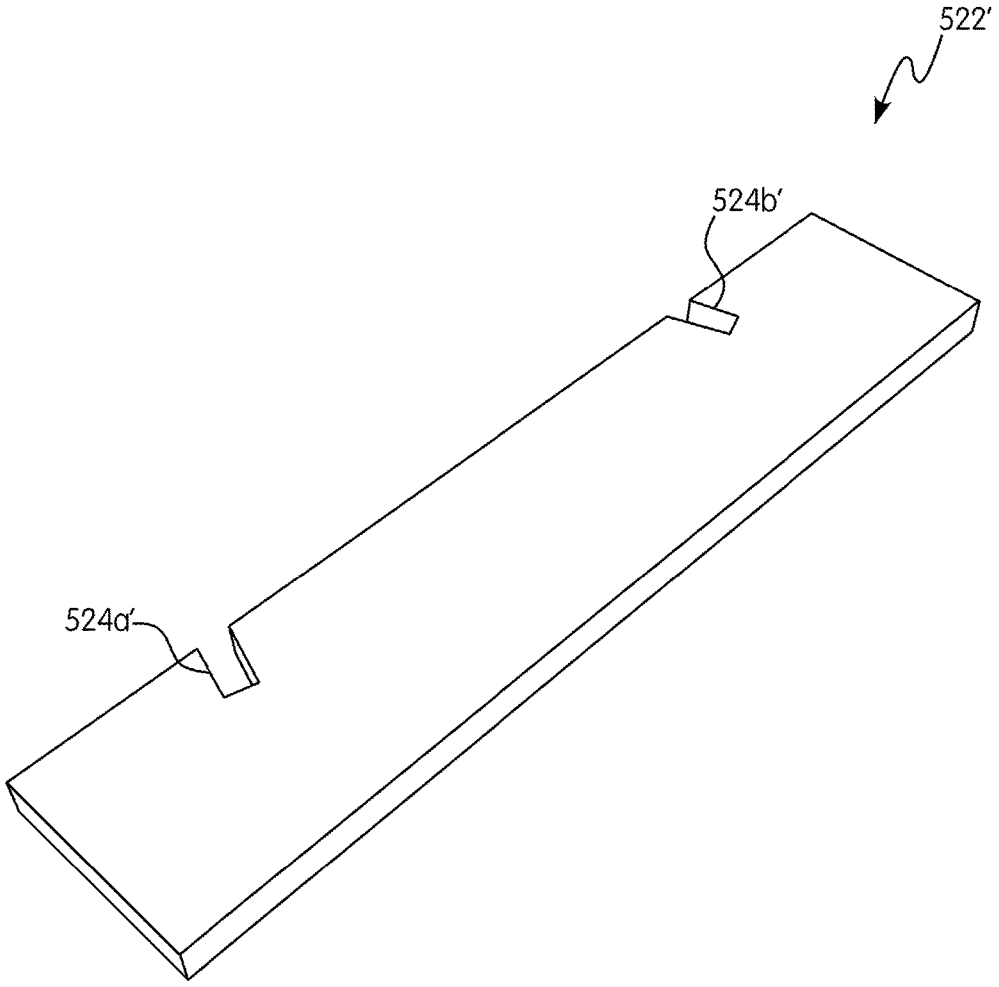
FIG. 25B is an enlarged perspective view of a spine member of the plurality of spine members of the curved vertical wall of FIG. 25A.

In accordance with another preferred embodiment, the present invention provides a method of constructing an architectural wall. The method includes the step of providing an architectural structure, such as architectural structure 10, which includes a plurality of paired slat-like members. Then, a spine is positioned about a midportion of the plurality of paired slat-like members to hold the plurality of paired slat-like members in an expanded state. Specifically, the spine holds the expandable central region of the paired slat-like members in the expanded state. Thereafter, second and third spines are attached to respective upper and lower ends of the expandable structure to hold the joined upper and lower ends of individual slats in the expanded state, as shown in FIG. 25B. Thereafter, insulation is positioned within the spaces or cavities formed by the individual slat-like members and spine elements. Preferably, to promote rigidity and add strength to the architectural wall, the insulation is expandable rigid foam insulation inserted within the cavities of the architectural wall.

Compressive strength and thermal resistance can increase the performance of the structural vertical spring partition assembly with the addition of, but not limited to, precut rigid insulation or mechanically sprayed expanding rigid foam. The thickness of the insulation is to be matched or determined by the width of paired slat-like members.

As discussed above, the present invention can be used to construct or create a variety of goods in a variety of different configurations. Further, owing to the nature and design of the expandable structure, the expandable structure is movable between a collapsed state and an expanded state. The expandable structure is also flexible in a direction transverse to its major wall surface. Thus, the expandable structure can advantageously be stored and shipped in the collapsed state or position thereby reducing storage space and shipping costs.

Moreover, owing to the unique design of the expandable structure in combination with the spine, the present invention can be rapidly assembled without undue burden associated with a plurality of fixtures and/or components necessary for assembly. That is, the architectural structures of the present invention can be easily and rapidly constructed and assembled due to the expandable design of the expandable structure and spine that is attachable to the expandable structure without additional components.

In accordance with an aspect of the present invention, the architectural structure can be configured as a workplace system and furniture which may include, but not limited to, workplace offices, semi-private workspaces, partition area dividers, suspended or non-suspended acoustical or non-acoustical ceiling features, decorative wall treatments with or without acoustical control, freestanding tables, credenzas, or seating structures. The architectural structure designs are assembled with two system components comprising a spine and a vertically oriented expandable structure of plurality of paired slat-like members. The expandable structure is spread apart or flexed to a designed length by the spine and resist compressive loads by distributing the bearing weight from the spine surface evenly into the center portion of the expandable structure at the common slip type joint of each section or paired slat-like members of the expandable structure by routed matching slip joints of the spine. The optional addition of the binding sheet may add additional lateral stability if required by the intended use and a standard or customized cover to increase privacy or for decorative use may be applied as an option to the architectural structure. The systems and related components may vary in length or height or shape including but limited to multiple curves, irregular curves, convex or compound curves in any combination or single straight sections. The system is designed to be flat packed to reduce shipping fees and may be assembled onsite with minimum skilled labor to reduce product cost and increase consumer appeal.

The spine is fabricated with evenly spaced routed fingers which are designed to spread apart the expandable structure. The spine is then slipped and locked into place with matching interlocking slip type joinery on the expandable structure preventing compressive vertical movement. The spine may be locked into position with mechanical or tensioned friction fasteners attached onto extended fingers of the spine along the outside edge of the expandable structure. The expandable structure can have added lateral structural competency and may be joined to adjacent systems to create a series of connected workspaces with the installation of e.g., a binding sheet. Depending on depth, the spine may serve several uses such as, but not limited to, a work area or multi-purpose storage or display surface. The spine provides extended fingers through the outside edge of the expandable structure to allow for the attachment of protective and decorative finishes. The inside extension of the spine allows for attachment of interior decorative finishes.

The spine can be shaped as desired and made of any structurally competent material including but not limited to, solid or veneered wood products, laminated engineered materials, composite fiberglass, polycarbonates, plastics, carbon fiber, ferrous or non-ferrous metals, or other exotic materials.

The expandable structure is fabricated with equal strips of any desired structurally competent material, which is able to transfer vertical loads from above and from lateral loads from by not limited to wind force or object impact. The vertical structural strips of the expandable structure are connected to each other with structurally competent surface applied adhesive or mechanical connection including frictional crimping by any mechanical method in a pattern which alternatively connects both ends of two vertical strips together creating a single spring sub component or paired slat-like members. Each single spring sub component is then connected to the next single spring sub component at the center of each outside exterior face of each spring sub component with the same structurally competent methods used previously.

The expandable structure can be configured as a structural vertical spring partition assembly, and made of any structurally competent material, including but not limited to, solid or veneered wood products, laminated engineered materials, composite fiberglass, polycarbonates, plastics, carbon fiber, ferrous or non-ferrous metals, or other exotic materials which are suitable for bending and able to accept the desired design loads applied.

The binding sheet can optionally be provided to induce a spring action to a flat sheet within the curved assembly above and below the spine within predesigned and routed slots within the expandable structure to create enough frictional resistance to add a moderate level of rigidity to the full assembly to help resist lateral movement. The binding sheet also offers a layer of privacy and may also extend into the adjacent unit through its own expandable structure to bind multiple units together.

The binding sheet can be made from equal material properties as the base architectural structure assembly or may be a separate material of choice with the same structural properties required to perform competently as needed.

A separate skin cover or assembly system can be custom designed and self-installed with overlapping panels placed over structural extensions attached to the top of and bottom of the expandable structure and then tethered with an elastic band assembly to rings attached to the structural extensions of the bottom of the expandable structure. The skin material can be, but not limited to, the same material inherent to the existing architectural structure assembly or a variety of materials with or without images appropriate for structural requirements needed for safe assembly to the base architectural structure.

In accordance with another aspect, the present invention provides an architectural structure having an expandable structure and spine configured as a rapid install environmental control wall system. The wall system may include, but not limited to, emergency shelters, permanent or non-permanent residential dwellings, permanent or non-permanent commercial or public occupied space, which may use the system for environmental, visual or acoustical control.

In accordance with an aspect of the present invention, the architectural structures can be assembled with five system components comprising a spine which also allows for the attachment of a protective finish on both sides, an expandable structure or spring partition assembly, a top and bottom bearing transfer assembly which evenly transfers vertical loads to the top of the expandable structure then re-transfers the loads from the bottom of the expandable structure through the bottom to the floor, and compressive resistant rigid or spray foam material which increases the structural competency of vertical compressive and lateral wind loads to the expandable structure and the spine by continuously binding the assemblies of the wall system together to evenly distribute the stress loads to the main structural assembly into the structurally efficient arched shape of the expandable structure.

The expandable structure is spread apart to a designed length owing to the flexible or bendable nature of the elongated slab by the spine and resist compressive loads by distributing the bearing weight from the spine surface evenly into the center portion of the expandable structure at the common slip type joint of each sub spring component of the expandable structure by routed matching slip joints of the spine. The systems and related components may vary in length or height or shape including but limited to multiple curves, irregular curves, convex or compound curves in any combination or single straight sections.

The spine allows for attachment of a protective finish on both sides of the expandable structure which evenly transfers vertical loads to the top of the expandable structure and then re-transfers the loads from the bottom of the expandable structure through the bottom to the floor. The spray foam rigid insulation increases the structural competency of vertical compressive and lateral loads. The expandable structure and spine evenly distribute the stress loads to the main structural assembly by continuously binding individual structures of the wall system together in a structurally efficient arc shape.

The top and bottom transfer assembly is fabricated with evenly spaced spine's routed fingers and designed to spread apart the expandable structure and is then slipped and locked into place with matching interlocking slip type joinery on the expandable structure. The same assembly is used to secure the bottom of the expandable structure. Two structurally competent bearing plates are then secured to both the top and bottom of the assembly with either structural adhesives or weather resistant mechanical fastening. The top and bottom extended fingers through the outside edge of the expandable structure to allow for the attachment of protective and decorative finishes.

Structural bearing plates can be made from bearing competent materials such as those described above for the expandable structure, but not limited to, pressure treated marine grade plywood or other corrosive resistant materials, which may accept adhesives or mechanical fastening.

The insulation or foam is introduced within the cavities of the architectural structure configured as a wall after being stretched or flexed to the designed length and applied as needed to expand and fill any cavities. Any insulation that extrudes beyond the face edges of both sides, is then sheared off with standard industry practices to align with the expandable structure of the wall. The overall compressive resistance of the foam is designed to equally transfer lateral loads created by vertical loads applied to the expandable structure back to the vertical system. Because the expandable structure is comprised of multiple structurally efficient arches, the wall absorbs the loads back to the design path.

The cover or skin assembly system can be installed onto the extensions provided by the spine, and the top and bottom plate assembly with mechanical fasteners or adhesive. The inherent space created by the spine and top and bottom assemblies provides minimal thermal and acoustical transfer. The cover may be formed out of a variety of materials for personal, thermal or environmental resistant needs.

In accordance with yet another aspect, the present invention provides an architectural structure configured as a rapid install column assembly which can be used in structural applications which may include, but not limited to, emergency shelters, permanent or non-permanent residential dwellings, permanent or non-permanent commercial or public occupied space, which may use the system for temporary, permanent or decorative uses.

The rapid install structural column assembly is fabricated with any structurally competent framing components including corrosion resistant steel, corrosion resistant fiberglass or carbon fiber based material, which can be used to create the expandable structure. Two individual slats are connected at the ends points of each member with, but not limited to, welding, mechanical fastening or mechanical compression. The paired slat-like members are then connected to each other at the center point of each assembly with the same connection process. The rapid install structural column assembly is then expanded to desired dimensions with a series of structurally competent rings with the desired diameter placed within the interior and tied to the vertical frame with standard rebar metal connection wire. The unit is then wrapped with structurally competent sheet material then filled with specified concrete.

The architectural structure can be configured as a rapid decorative column assembly fabricated with equal strips of any desired bendable material including but not limited to solid or laminated wood products, laminated fiberglass or carbon fiber, plastics, acrylic or any fiber composite materials. The vertical structural strips are connected to each other with any structurally competent surface applied adhesive or mechanical connection method including frictional crimping by any mechanical method in a pattern which alternatively connects both ends of two vertical strips together creating a single spring sub component. Each single spring sub component is then connected to the next single spring sub component at the center of each outside exterior face of each spring sub component with the same structurally competent methods used previously. The assembly is stretched around any desired element or form and connected back to the vertical spring assembly with adhesive or mechanical connections.

Figure 24A:
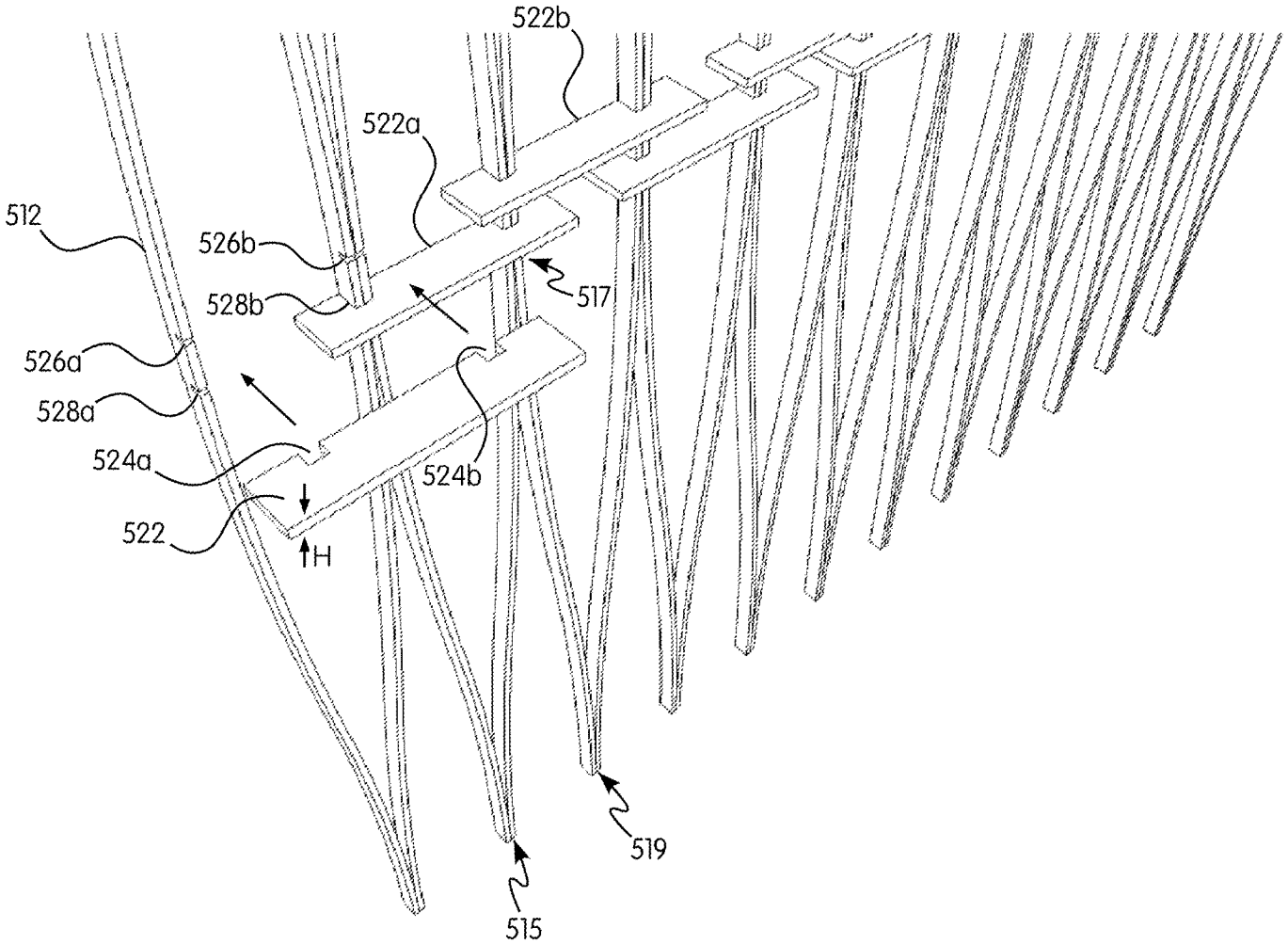
FIG. 24A is a partial perspective view of an architectural structure configured as a vertical wall partition having a plurality of spine members in accordance with another preferred embodiment of the present invention.
Figure 24B:
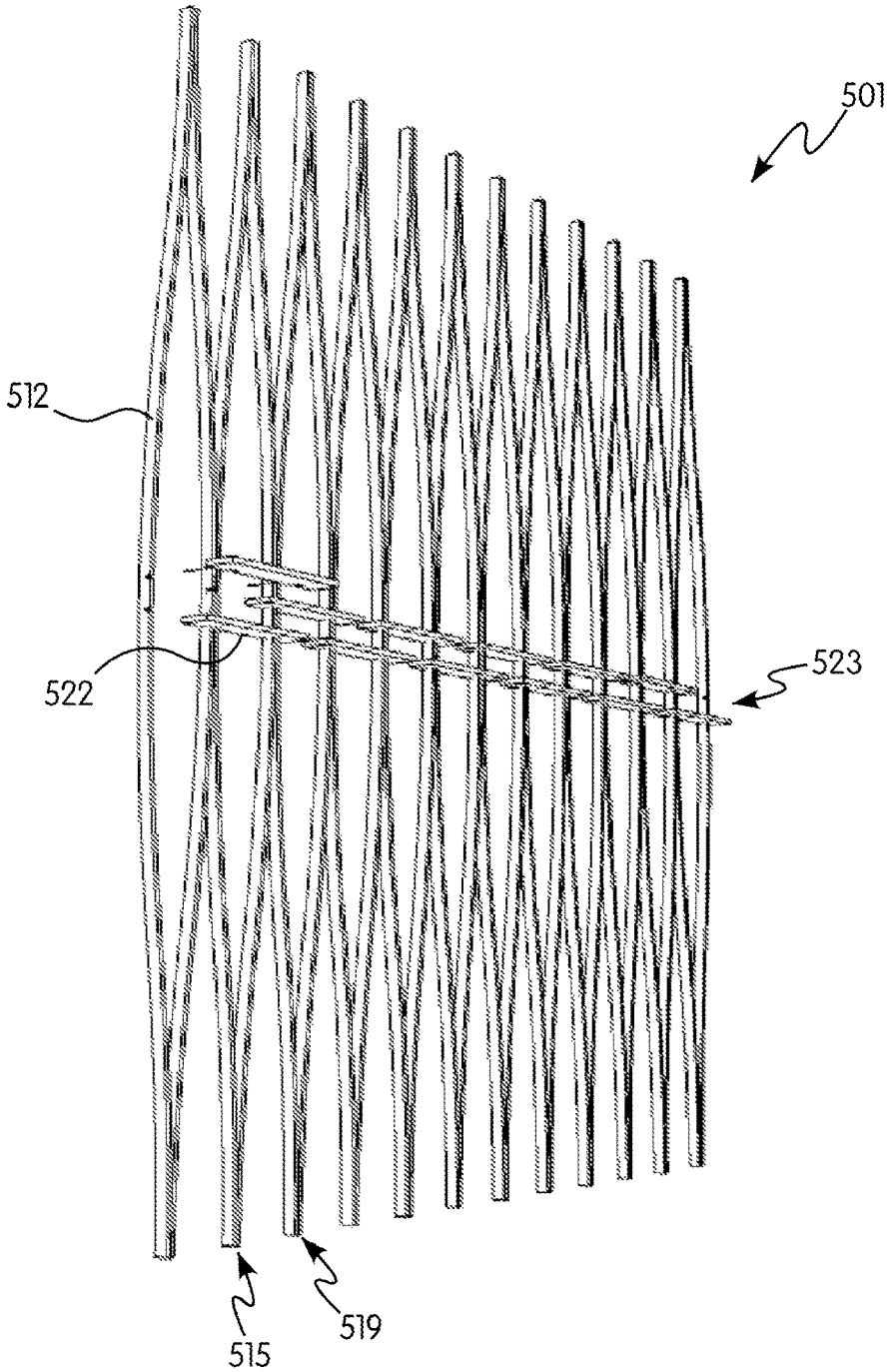
FIG. 24B is a perspective view of the vertical wall partition of FIG. 24A.

Referring to FIGS. 24A and 24B, in accordance with another preferred embodiment of the present invention, the spine can be configured as a plurality of individual spine members 522 (including 522*a* and 522*b*) that work collectively to form an elongated spine assembly 523 for supporting the expandable structure 512 in the expanded position. Each individual spine member 522 is configured as shown in FIGS. 24A, 24B. Specifically, the spine member is a substantially thin planar member sized to have a horizontal width sufficient to support a pair of slats joined at its upper and lower ends i.e., a paired slat-like member, in the expanded position.

The spine member 522 includes spaced apart first and second slots 524*a*, 524*b*, respectively. The thickness H of the spine member and the width of the first and second slots 524*a*, 524*b* are sized to frictionally engage first level corresponding slots 526*a*, 526*b* formed on individual slats of the expandable structure 512, so as to form a slip joint or slip type joinery, which may also be know as a slot in joint or cross lap joint. As such, a single spine member is configured to fixedly engage and support a single paired slat-like member in the expanded position. In sum, each individual spine member consists essentially of two spaced apart slip joints.

Alternatively, each individual spine member can be configured to consist essentially of more than two slots for supporting multiple paired slat-like members. For example, each spine member can include three slots for supporting two paired slat-like members, four slots for supporting three paired slat-like members, five slots for supporting four paired slat-like members or six slots for supporting five paired slat-like members.

Referring to FIG. 24A, the spine member 522 is illustrated as an end unit spine member. As such, the width of slot 524*a* is sized to receive a width of a single slat, whereas the width of slot 524*b* is sized to be twice that of the width of slot 524*a* as it is sized to receive a width of two slats joined together at respective midportions.

The expandable structure 512 also includes second level corresponding slots 528*a*, 528*b* spaced apart from and similarly configured to first level corresponding slots 526*a*, 526*b*. Each of the first and second level corresponding slots are positioned about a midportion of the expandable structure. Thus, when the expandable structure 512 is assembled with two or more spine members 522, adjacent spine members e.g., spine members 522*a*, 522*b* overlap. That is, adjacent paired slat-like members e.g., 515 and 519 joined about their midportions 517 have spaced apart or adjacently positioned overlapping spine members 522*a*, 522*b*.

FIGS. 24A and 24B illustrate the expandable structure and plurality of spine members in the construction of a linear vertical wall 501. FIG. 25A illustrates the expandable structure and plurality of spine members configured to form a curved vertical wall structure 501'.

Referring to FIGS. 25A and 25B, the curved vertical wall structure 501' includes a plurality of spine members 522'. Each spine member 522' is configured to receive the expandable structure so as to define a curved wall. Specifically, the spine member 522' is configured with corresponding slots 524*a*' and 526*b*' that are angled with respect to each other and/or angled with respect to a longitudinal axis of the spine member 522'. That is, the slots 524*a*', 524*b*' are angled to a desired degree sufficient to match a desired degree of curvature of the resulting wall structure 501'.

In sum, alternate single person fabrication unit designs may use the slip connection technology with the multi spine design that spans between two vertical slats in an alternating high low stagger with matching slots in the vertical expandable structure. Curved architectural structures may be created with the fabrication of angled slots on the spine with the desired angle to match the diameter of the workstation or wall unit structure.

The foregoing expandable structure 512 and plurality of spine members 522 advantageously makes it easier for a single user to erect and assemble the architectural structure. The foregoing also allows a user to assemble an architectural structure to any desired length by using a desired number of spine members so as not to be limited to the size of any particular unitary spine. Further, the foregoing allows the architectural structure to be curved or with multiple radius and directions as desired by the user to allow variations in design.

Figure 26:
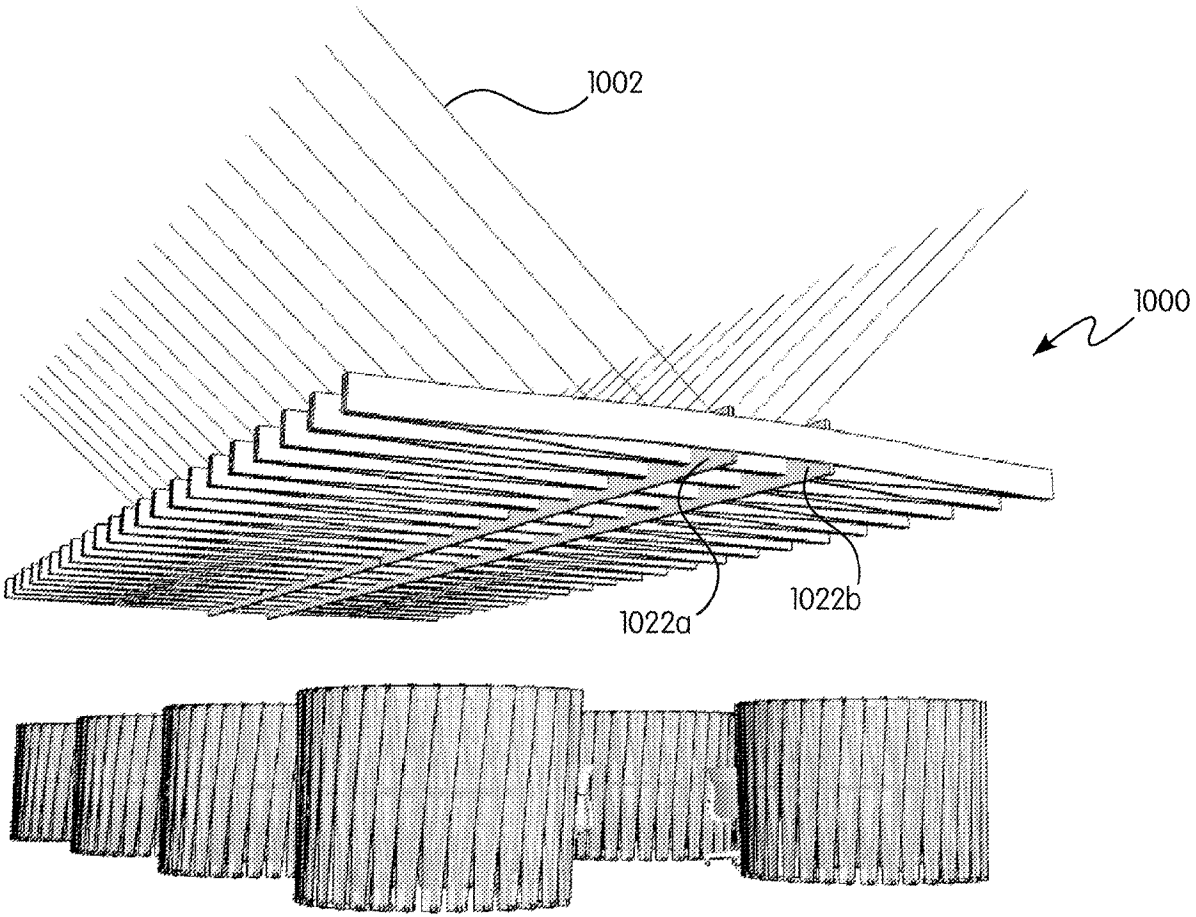
FIG. 26 is a perspective view of an architectural structure configured as a ceiling structure in accordance with another preferred embodiment of the present invention.

Referring to FIG. 26, in accordance with another aspect of the present invention, the architectural structure can be configured as a ceiling structure 1000. The ceiling structure can be configured as any linear wall structure described above but arranged as shown in FIG. 26 so that its major wall face serves as the inside ceiling face.

Preferably the ceiling structure 1000 is configured as a linear ceiling wall having spaced apart first and second spines 1022*a*, 1022*b* for supporting the expandable structure in the expanded state. The ceiling structure 1000 can be attached to a ceiling frame member (not shown) by supports 1002. The supports 1002 are preferably cables, but can alternatively be any other support capable of attaching the ceiling structure to the ceiling frame such as rope, wire, wood, framing structures, fasteners, and the like.

The supports can be directly attached to the first and second spines 1022*a*, 1022*b*. The first and second spines 1022*a*, 1022*b* are configured and assembled to the expandable structure so that the open face of its slots face upwardly, when viewed as shown in FIG. 26. As such, with the supports 1002 directly attached only to the first and second spines 1022*a*, 1022*b*, the entire ceiling structure 1000 is fully supported.

It will be appreciated by those skilled in the art that changes could be made to the embodiments described above without departing from the broad inventive concept thereof. For example, alternative components and designs of the spine and its shape and structure can be used. It is to be understood, therefore, that this invention is not limited to the particular preferred embodiments disclosed, but it is intended to cover modifications within the spirit and scope of the present invention as defined by the appended claims.

We claim:

1. An architectural structure comprising:

no more than one row of vertically oriented expandable structures, the expandable structures including: a plurality of slats each having a convex curve, the plurality of slats comprising:

a first slat having a first major surface, a second major surface opposite the first major surface, an upper most end, a lower most end, and no more than one convex curve about a midportion between the upper most and lower most ends of the first slat, a second slat having a first major surface, a second major surface opposite the first major surface, an upper most end, a lower most end, and no more than one convex curve about a midportion between the upper most and lower most ends of the second slat, thereby defining not more than one diverging section and one converging section of the first and second slats, wherein the first and second slats include no more than two connections, to each other a first connection connecting their respective upper most ends, and a second connection connecting their respective lower most ends of the first and second slats, and wherein the first and second slats are directly connected to each other at their respective first major surfaces, a third slat having a first major surface, a second major surface opposite the first major surface, an upper most end, a lower most end, and no more than one convex curve about a midportion between the upper most and lower most ends of the third slat, wherein the respective midportions of the second and third slats are directly connected to each other at their respective second major surfaces, and, a fourth slat having a first major surface, a second major surface opposite the first major surface, an upper most end, a lower most end, and no more than one convex curve about a midportion between the upper most and lower most ends of the third slat, thereby defining not more than one diverging section and one converging section of the third and fourth slats, wherein the third and fourth slats include no more than two connections, to each other a first connection connecting their respective upper most ends, and a second connection connecting their respective lower most ends of the fourth and third slats, and wherein the third and fourth slats are directly connected to each other at their respective first major surfaces, wherein the expandable structure is moveable between a collapsed position and an expanded position;

a spine configured to maintain the expandable structure in the expanded position and positioned about a middle portion between the upper and lower most ends of the first, second, third and fourth slats, a top plate directly attached to each of the first, second, third, and fourth slats completely covering the upper most end of the first, second, third, and fourth slats, and a bottom plate directly attached to each of the first, second, third, and fourth slats completely beneath the lower most ends of the first, second, third, and fourth slats.

2. The architectural structure of claim 1, wherein the spine is an elongated spine, a table top, a planar member, or a pliable sheet.

3. The architectural structure of claim 1, wherein the spine includes a plurality of spaced apart apertures for receiving a portion of the expandable structure.

4. The architectural structure of claim 1, further comprising insulation between the first, second, third and fourth slats.

5. The architectural structure of claim 1, wherein the spine comprises a plurality of individual spine members configured to hold the expandable structure in the expanded position.

6. The architectural structure of claim 1, further comprising a cantilever member extending from the expandable structure about the spine.

7. The architectural structure of claim 1, further comprising a plurality of vertical blinds connected to the expandable structure.

8. The architectural structure of claim 1, further comprising a panel assembly that includes:

a bracket attached to the joined upper ends of the first and second slats; and a panel connected to the bracket.

9. The architectural structure of claim 1, wherein the architectural structure is a room partition, furniture, a cubicle, a building frame, or artwork.

10. The architectural structure of claim 1, further comprising a cover covering a side of the expandable structure that is substantially transverse to the major surfaces of the first and second slats.

11. The architectural structure of claim 1, further comprising a binding sheet for maintaining the expandable structure in an expanded position.

12. A method of constructing an architectural wall comprising:

providing an architectural structure of claim 1;

assembling the spine to the plurality of paired slat-like members; and inserting insulation between the slat-like members of the plurality of paired slat-like members.

13. The architectural structure of claim 1, wherein the spine is a unitary structure configured to removably maintain all of the slat-like members in an expanded state.

* * * * *